US006672897B2

(12) United States Patent
Tseng

(10) Patent No.: US 6,672,897 B2
(45) Date of Patent: Jan. 6, 2004

(54) BULB-HOLDER FOR USE IN A DECORATIVE LAMP

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 40 days.

(21) Appl. No.: 10/003,379

(22) Filed: Oct. 30, 2001

(65) Prior Publication Data

US 2003/0082947 A1 May 1, 2003

(51) Int. Cl.[7] ..... H01R 11/00
(52) U.S. Cl. ..... 439/505; 362/249
(58) Field of Search ..... 439/505, 575, 439/602, 456–459, 460; 362/396, 252, 391, 806, 249, 250

(56) References Cited

U.S. PATENT DOCUMENTS

D294,457 S * 3/1988 Doty et al. ..... D8/373
5,632,552 A * 5/1997 Wang et al. ..... 362/396
6,190,021 B1 * 2/2001 Huang ..... 362/227
6,341,881 B1 * 1/2002 Huang ..... 362/391
6,428,184 B1 * 8/2002 Huang ..... 362/226
6,443,595 B1 * 9/2002 Tseng ..... 362/250

* cited by examiner

*Primary Examiner*—P. Austin Bradley
*Assistant Examiner*—Phuongchi Nguyen
(74) *Attorney, Agent, or Firm*—Dellett & Walters

(57) ABSTRACT

A bulb-holder for use in a decorative lamp is disclosed. The bulb-holder includes a tubular body having a first end defining a cord hole and a second end defining a bulb-receiving opening. The tubular body further has a first wing formed with a first mouth opening and an opposed second wing formed with a second mouth opening. The bulb-holder is intended to be attached to a decorative fence that has tracks consisting of two spaced rails each. In this way, a bulb plugged in the holder may be situated between the rails and gives out light to both sides of the fence.

2 Claims, 20 Drawing Sheets

BULB-HOLDER FOR USE IN A DECORATIVE LAMP

BACKGROUND OF THE INVENTION

1. Field of the Invention

The present invention relates to a bulb-holder for use in a decorative lamp and, more particularly, to a bulb-holder for use in a decorative lamp in which bulbs can give out light to both sides of the lamp.

2. Description of Related Art

Decorative lamps are famous for their glowing at nights of festivals, especially on Christmas Eve. These lamps are generally connected with power cords, in order to be suspended above ground or to be wound around what is to be bedecked.

A special decorative lamp has been proposed by the present applicant which includes a foldable frame and a plurality of bulb-holders held on the frame in a particular arrangement. This decorative lamp can be put into use immediately after the frame is unfolded, without suspending or winding it.

However, it has been found that light from bulbs of the lamp is blocked by the frame, that is, the bulbs can give out light afar only to a single side of the lamp. This discounts the value of the lamp during its use.

Therefore, it is an objective of the invention to provide a bulb-holder to mitigate and/or obviate the aforementioned problems.

SUMMARY OF THE INVENTION

The object of the present invention is to provide a bulb-holder for use in a decorative lamp.

Other objects, advantages and novel features of the invention will become more apparent from the following detailed description when taken in conjunction with the accompanying drawings.

DETAILED DESCRIPTION OF THE PREFERRED EMBODIMENT

Figure 1:
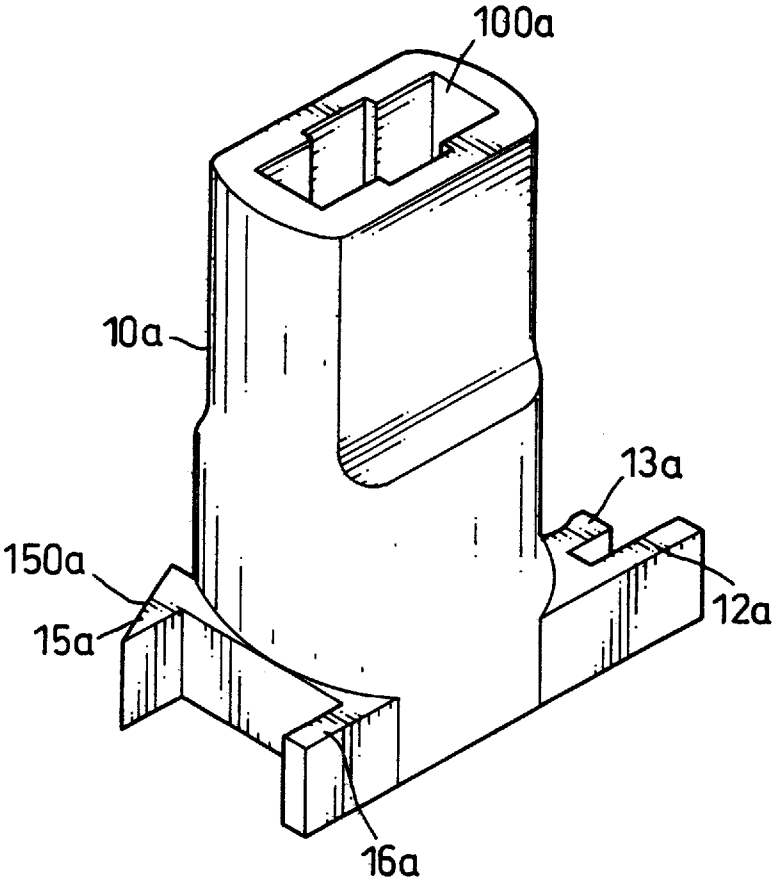
FIG. 1 has two perspective views, viewed in diametrically opposite directions, of a first embodiment of a bulb-holder in accordance with the present invention.
Figure 1:
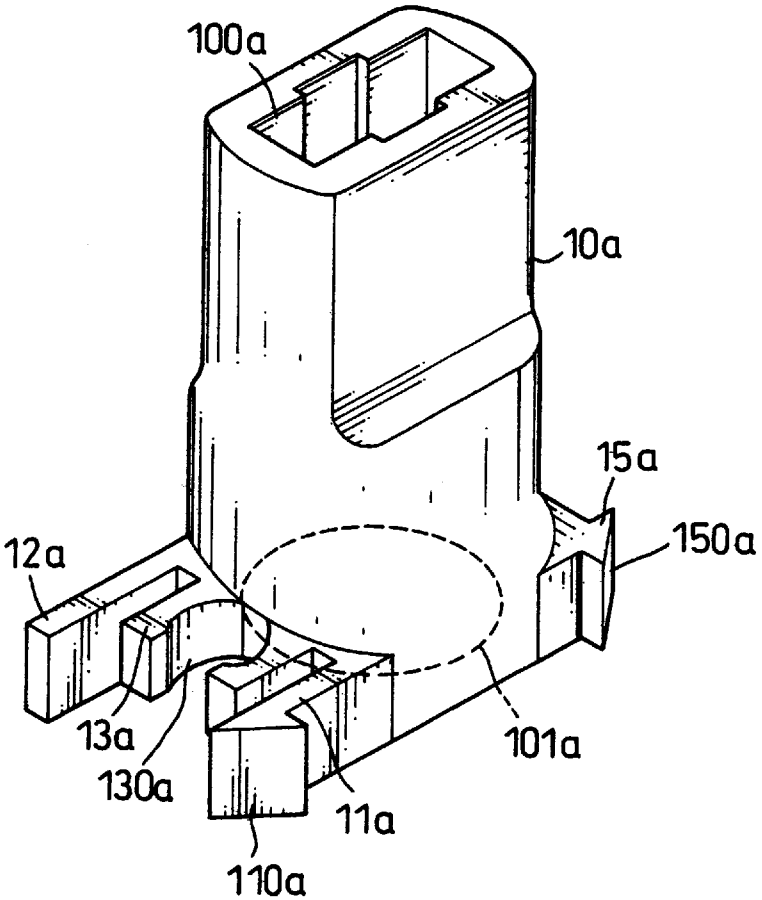

FIG. 1 shows two perspective views, viewed in diametrically opposite directions, of a first embodiment of a bulb-holder in accordance with the present invention. The bulb-holder includes a tubular body (10*a*) having a first end defining a cord hole (100*a*) and a second end defining a bulb-receiving opening (101*a*). A first wing (not numbered) and an opposed second wing (also not numbered) extend outward from the tubular body (10*a*) near the second end.

The first wing is formed with a first mouth opening (not numbered) which is delimited laterally by a first long jaw (11*a*) and a spaced second long jaw (12*a*). The first long jaw (11*a*) has an outer inclined face (110*a*) formed at a distal end thereof. The first mouth opening is delimited inwardly by a mouth base from which a pair of spaced tonsils (13*a*) extends outwardly and defines a C-shaped notch (130*a*) therebetween.

The second wing is formed with a second mouth opening (not numbered) which, however, is delimited laterally by a first short jaw (15*a*) and a second short jaw (16*a*). The first short jaw (15*a*), substantially opposed to the first long jaw (11*a*), has an outer inclined face (150*a*) formed at a distal end thereof in correspondence with the outer inclined face (110*a*) of the first long jaw (11*a*).

Figure 2:
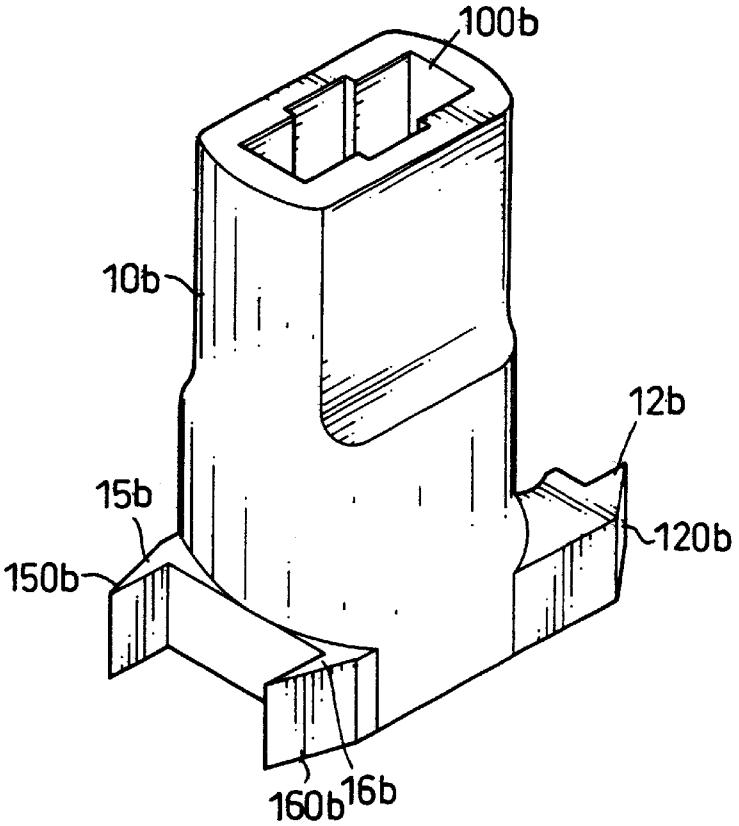
FIG. 2 has two perspective views, viewed in diametrically opposite directions, of a second embodiment of the inventive bulb-holder.
Figure 2:
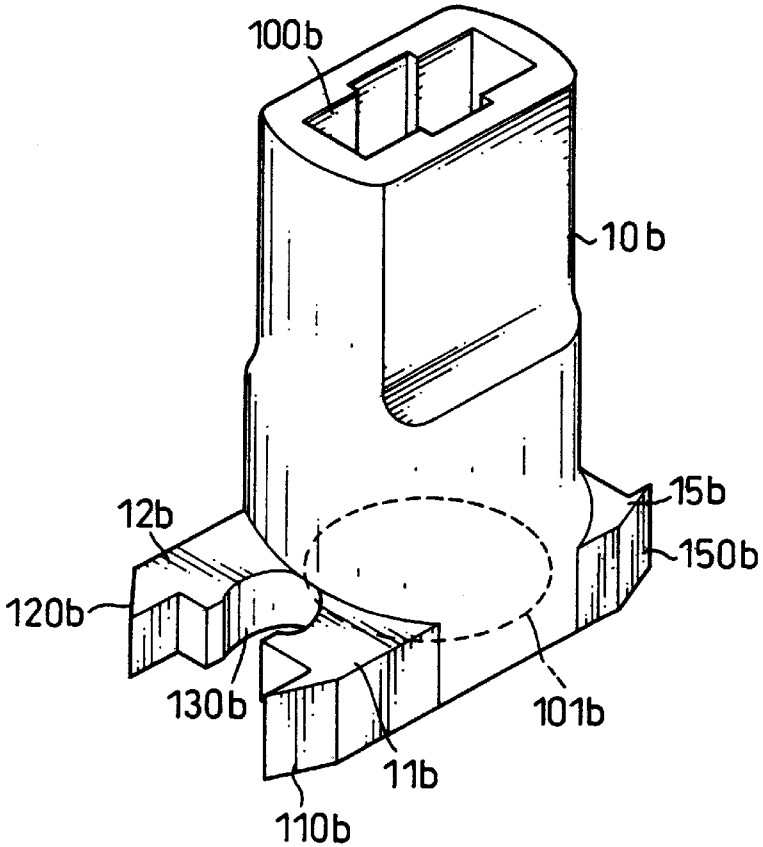

FIG. 2 shows two perspective views, viewed in diametrically opposite directions, of a second embodiment of the inventive bulb-holder. The bulb-holder here includes a tubular body (10*b*) having a first end defining a cord hole (100*b*)

and a second end defining a bulb-receiving opening (101*b*), with opposed first and second wings (not numbered) extending outward from the tubular body (10*b*) near the second end.

In this embodiment, the first wing is formed with a first mouth opening (not numbered) delimited laterally by a first long jaw (11*b*) and a second long jaw (12*b*), with each long jaw (11*b*, 12*b*) having an outer inclined face (110*b*, 120*b*) formed at a distal end thereof. The first mouth opening is delimited inwardly by a mouth base that defines a C-shaped notch (130*b*) therein.

The second wing is formed with a second mouth opening (not numbered) delimited laterally by a first short jaw (15*b*) and a second short jaw (16*b*). The short jaws (15*b*,16*b*) are substantially opposed to the long jaws (11*b*, 12*b*), and have respective outer inclined faces (150*b*, 160*b*) formed at distal ends thereof in correspondence with those faces (110*b*, 120*b*) of the long jaws (11*b*, 12*b*) of the first wing.

Figure 3:
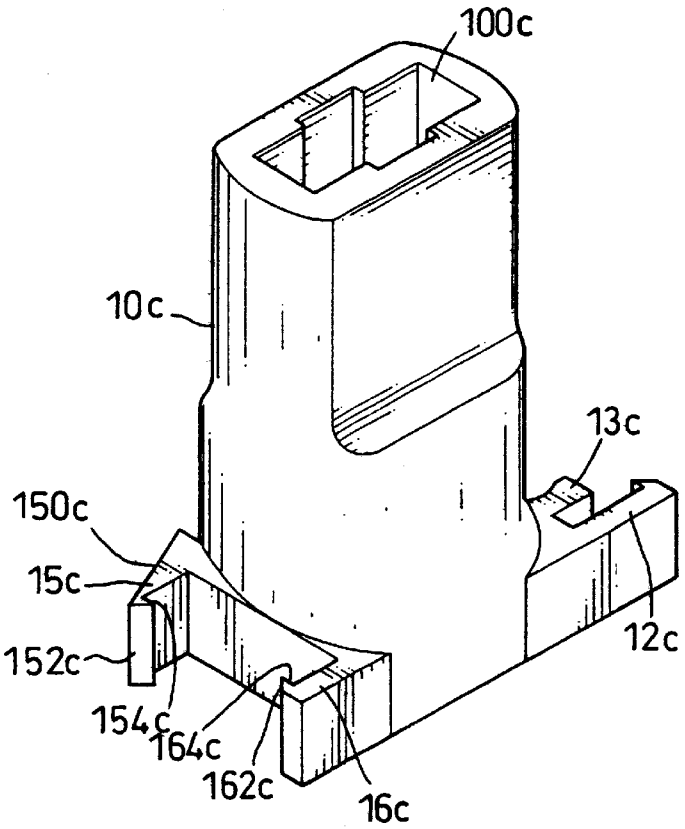
FIG. 3 has two perspective views, viewed in diametrically opposite directions, of a third embodiment of the inventive bulb-holder.
Figure 3:
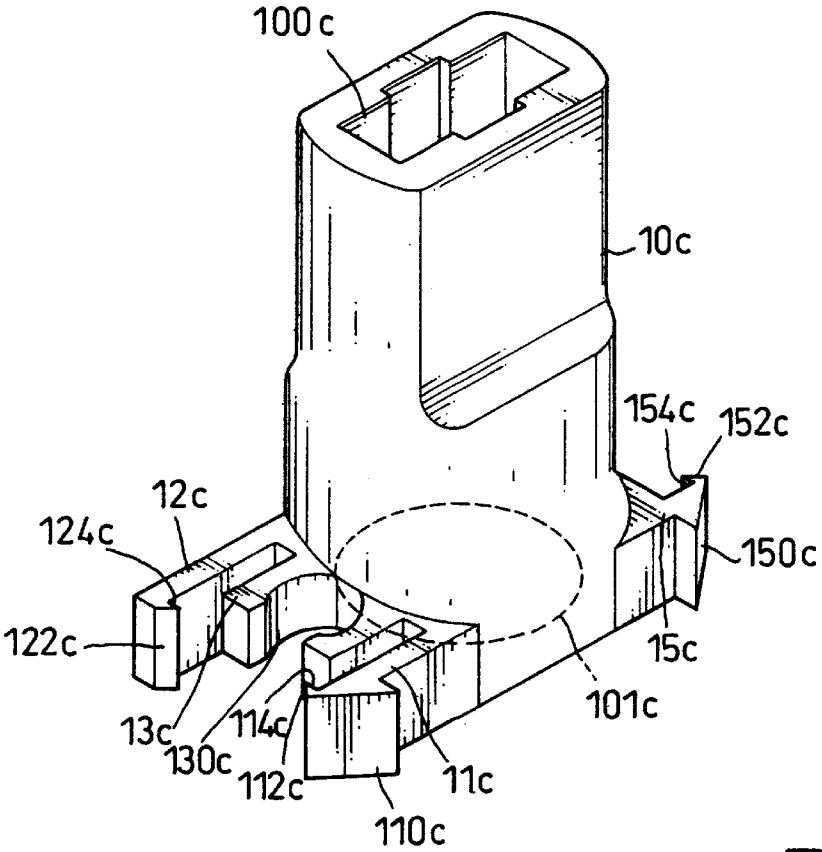

FIG. 3 shows two perspective views, viewed in diametrically opposite directions, of a third embodiment of the inventive bulb-holder. The bulb-holder includes a tubular body (10*c*) having a first end defining a cord hole (100*c*) and a second end defining a bulb-receiving opening (101*c*), with opposed first and second wings (not numbered) extending outward from the tubular body (10*c*) near the second end.

The first wing is formed with a first mouth opening (not numbered) delimited laterally by a first long jaw (11*c*) and a second long jaw (12*c*), with only the first long jaw (11*c*) having an outer inclined face (110*c*) formed at a distal end thereof. The first mouth opening is delimited inwardly by a mouth base from which a pair of spaced tonsils (13*c*) extends outwardly and defines a C-shaped notch (130*c*) therebetween.

The second wing is formed with a second mouth opening (not numbered) delimited laterally by a first short jaw (15*c*) and a second short jaw (16*c*). The first short jaw (15*c*) is substantially opposed to the first long jaw (11*c*), and has an outer inclined face (150*c*) formed at a distal end thereof in correspondence with the outer inclined face (110*c*) of the first long jaw (11*c*).

The two wings are similar to those in the first embodiment, except that each of the jaws (11*c*, 12*c*, 15*c*, 16*c*) now has an additional inner barb (114*c*, 124*c*, 154*c*, 164*c*) formed thereon and these inner barbs (114*c*, 124*c*, 154*c*, 164*c*) form respective inner inclined faces (112*c*, 122*c*, 152*c*, 162*c*) at distal ends of the jaws (11*c*, 12*c*, 15*c*, 16*c*).

Figure 4:
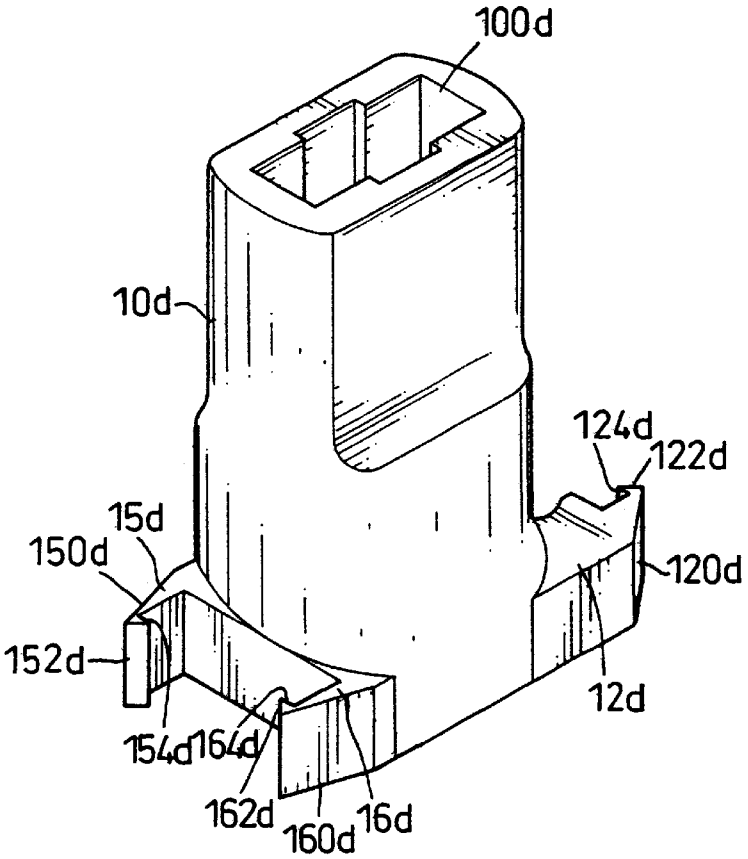
FIG. 4 has two perspective views, viewed in diametrically opposite directions, of a fourth embodiment of the inventive bulb-holder.
Figure 4:
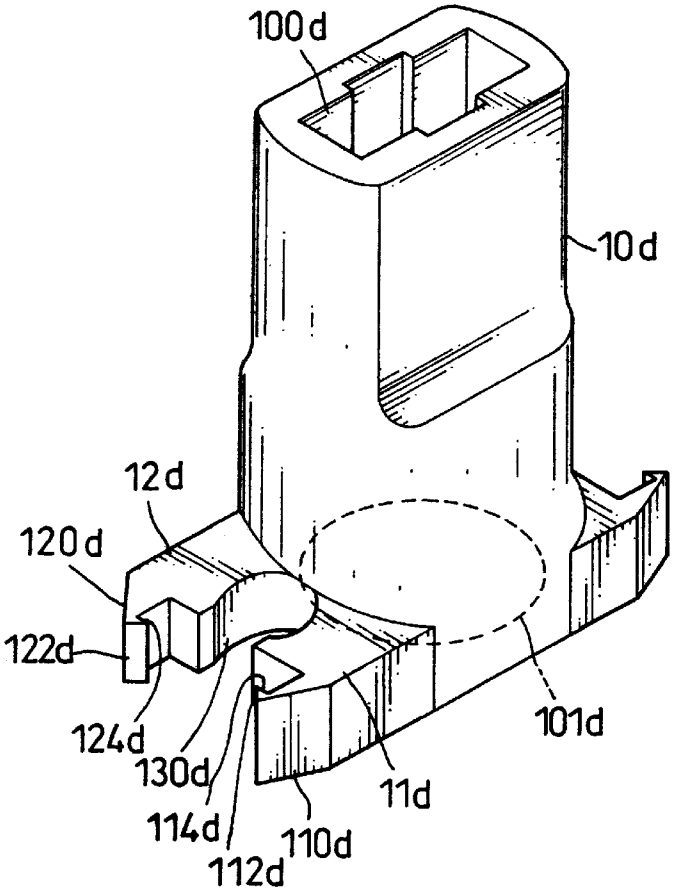

FIG. 4 shows two perspective views, viewed in diametrically opposite directions, of a fourth embodiment of the inventive bulb-holder. The bulb-holder now includes a tubular body (10*d*) having a first end defining a cord hole (100*d*) and a second end defining a bulb-receiving opening (101*d*), with opposed first and second wings (not numbered) extending outward from the tubular body (10) near the second end.

In this embodiment, the wings are similar to those in the second embodiment, respectively. In detail, the first wing here is formed with a first mouth opening (not numbered) delimited laterally by a pair of long jaws (11*d*, 12*d*), which each have an outer inclined face (110*d*, 120*d*) formed at a distal end thereof. The first mouth opening is delimited inwardly by a mouth base that defines a C-shaped notch (130*d*) therein.

The second wing here is formed with a second mouth opening (not numbered) delimited laterally by a first short jaw (15*d*) and a second short jaw (16*d*). The short jaws (15*d*,16*d*) are substantially opposed to the long jaws (11*d*, 12*d*), and have respective outer inclined faces (150*d*, 160*d*) formed at distal ends thereof in correspondence with the outer inclined face (110*d*, 120*d*) of the long jaws (11*d*, 12*d*) of the first wing.

The difference between this fourth embodiment and the second embodiment is that now each of the jaws (11*d*, 12*d*, 15*d*, 16*d*) has an additional inner barb (114*d*, 124*d*, 154*d*, 164*d*) formed thereon. These inner barbs (114*d*, 124*d*, 154*d*, 164*d*) form respective inner inclined faces (112*d*, 122*d*, 152*d*, 162*d*) at distal ends of the jaws (11*d*, 12*d*, 15*d*, 16*d*).

Figure 5:
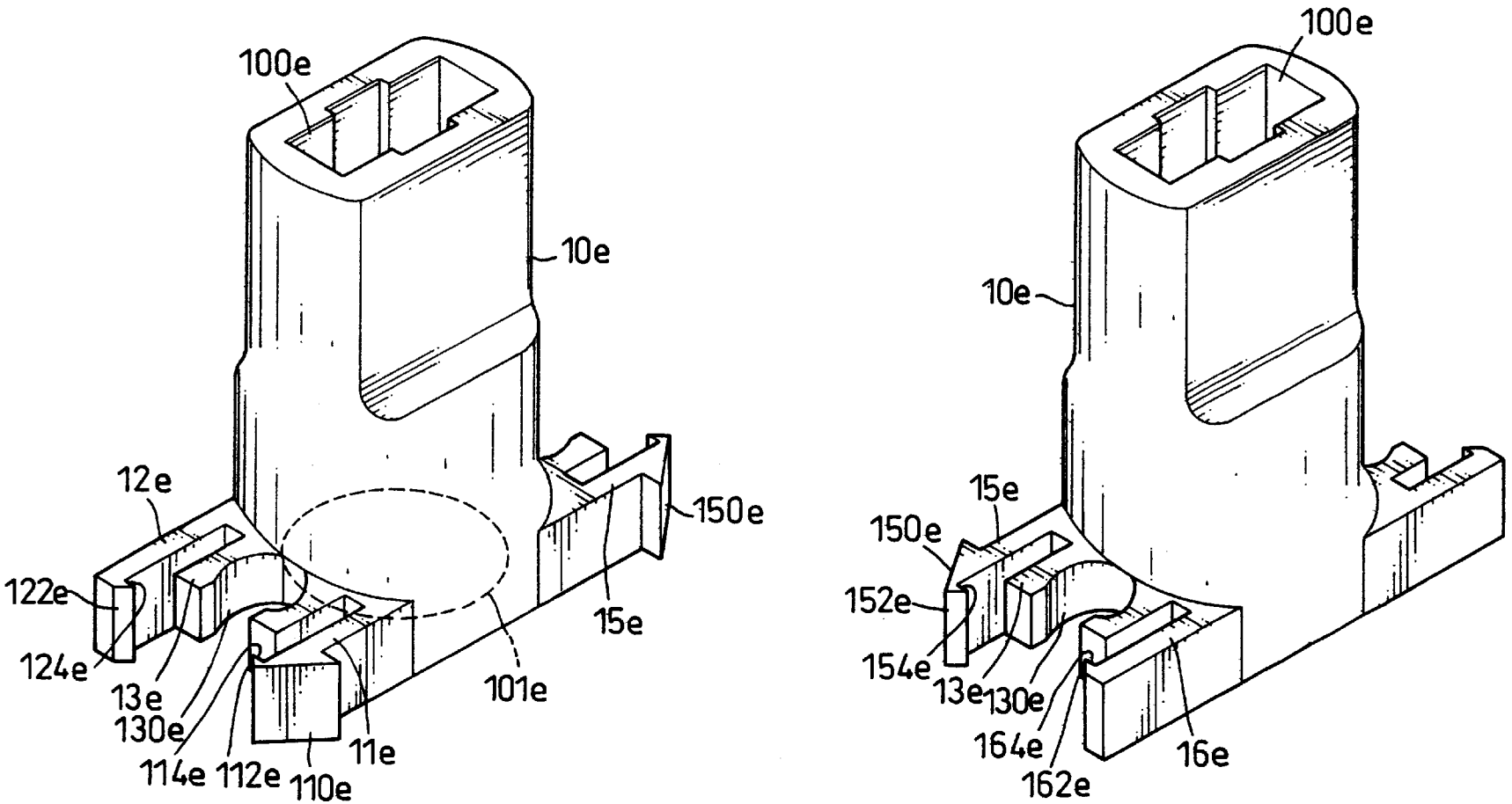
FIG. 5 has two perspective views, viewed in diametrically opposite directions, of a fifth embodiment of the inventive bulb-holder.

FIG. 5 shows two perspective views, viewed in diametrically opposite directions, of a fifth embodiment of the inventive bulb-holder. The bulb-holder now includes a tubular body (10*e*) having a first end defining a cord hole (100*e*) and a second end defining a bulb-receiving opening (101*e*), with a pair of opposed wings (not numbered) extending outward from the tubular body (10*e*) near the second end.

The two wings are symmetrically formed about the tubular body (10*e*), and each have the same configuration as the first wing in the third embodiment shown in FIG. 3.

That is to say, each of the wings here is formed with a mouth opening (not numbered) delimited laterally by a first long jaw (11*e*, 15*e*) and a second long jaw (12*e*, 16*e*). with the first jaw (11*e*, 15*e*) having an outer inclined face (110*e*, 150*e*) formed at a distal end thereof, and with each jaw (11*e*, 12*e*, 15*e*, 16*e*) having an inner barb (114*e*, 124*e*, 154*e*, 164*e*), which forms an inner inclined face (112*e*, 122*e*, 152*e*, 162*e*) at a distal end of the jaw (11*e*, 12*e*, 15*e*, 16*e*).

The mouth opening is delimited inwardly by a mouth base from which a pair of spaced tonsils (13*e*) extends outwardly, and the two tonsils (13*e*) define a C-shaped notch (130*c*) therebetween.

Figure 6:
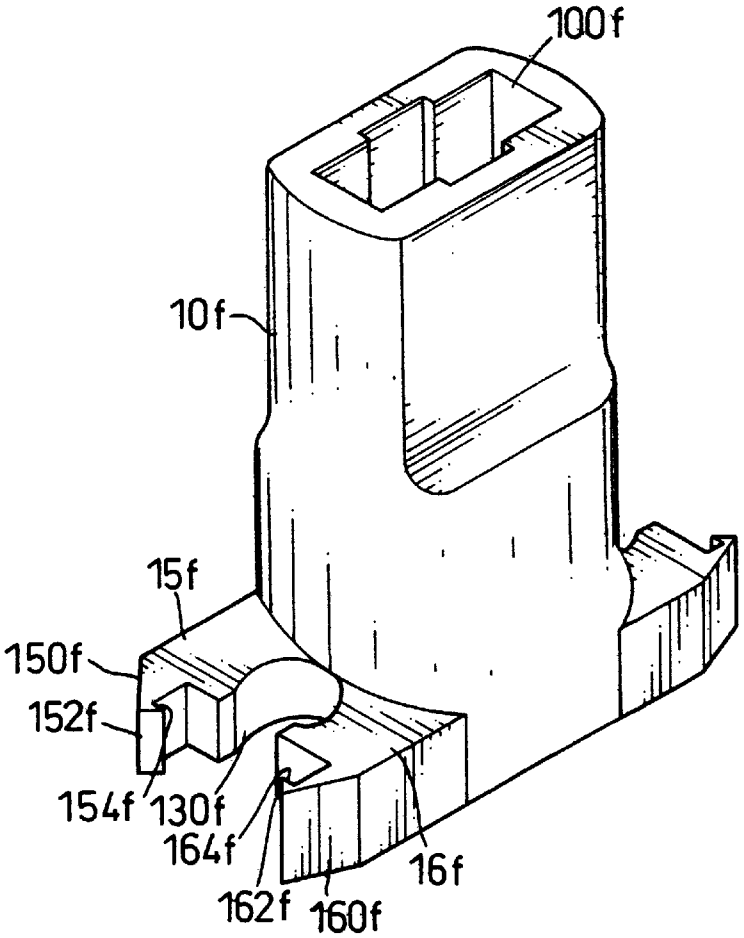
FIG. 6 has two perspective views, viewed in diametrically opposite directions, of a sixth embodiment of the inventive bulb-holder.
Figure 6:
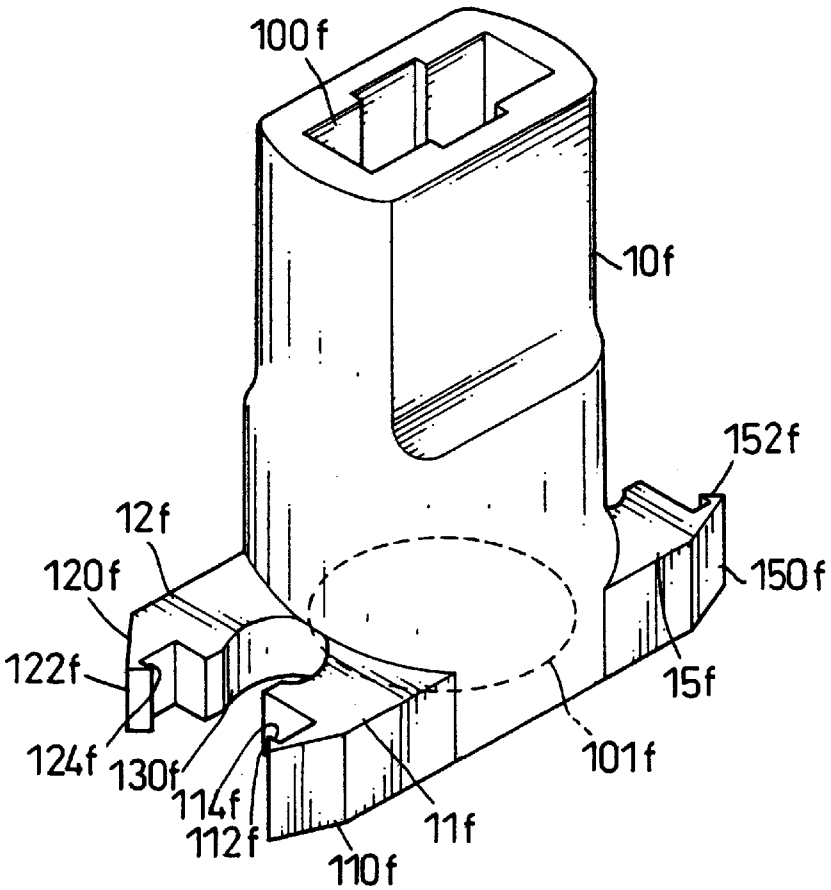

FIG. 6 shows two perspective views, viewed in diametrically opposite directions, of a sixth embodiment of the inventive bulb-holder. The bulb-holder here includes a tubular body (10*f*) having a first end defining a cord hole (100*f*) and a second end defining a bulb-receiving opening (101*f*), with a pair of opposed wings (not numbered) extending outward from the tubular body (10*f*) near the second end.

The two wings are also symmetrically formed about the tubular body (10*f*), but each have the same configuration as the first wing in the fourth embodiment shown in FIG. 4.

In detail, each of the wings here is formed with a mouth opening (not numbered) delimited laterally by a pair of long jaws (11*f*, 12*f*; 15*f*, 16*f*), which each have an outer inclined face (110*f*, 120*f*; 150*f*, 160*f*) formed at a distal end thereof and each have an inner barb (114*f*, 124*f*; 154*f*, 164*f*) that forms an inner inclined face (112*f*, 122*f*, 152*f*, 162*f*) at the distal end of the jaw (11*f*, 12*f*, 15*f*, 16*f*).

Furthermore, each mouth opening is delimited inwardly by a mouth base that defines a C-shaped notch (130*f*) therein.

Figure 7:
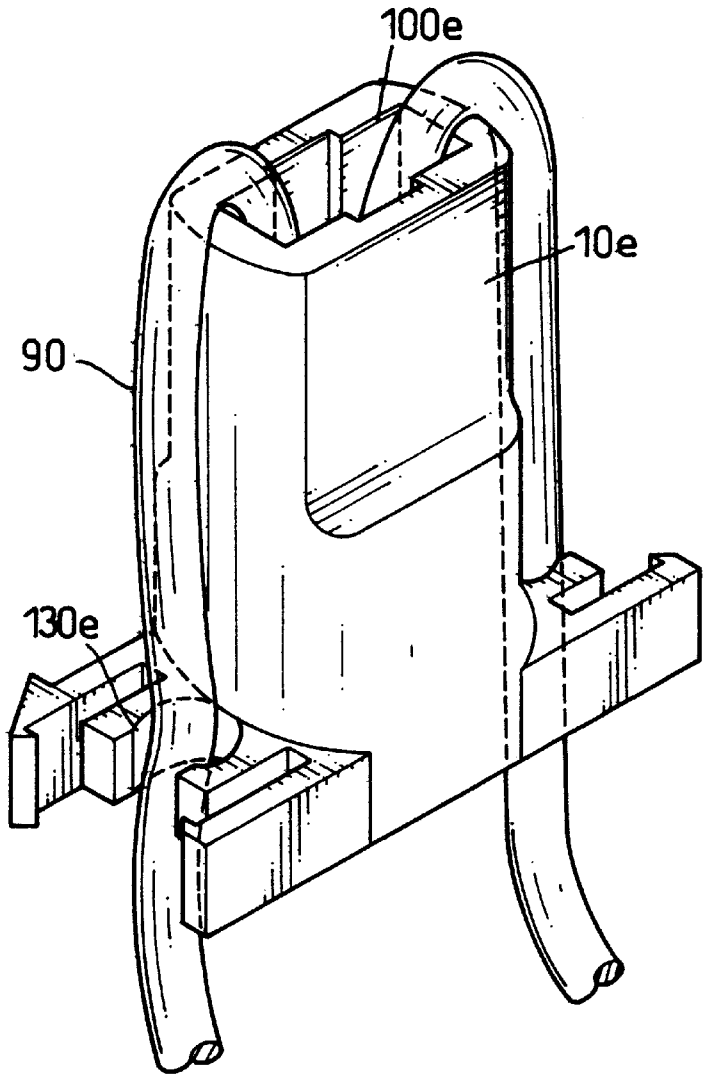
FIG. 7 has two perspective views in diametrically opposite directions, showing the fifth embodiment of the bulb-holder provided with a pair of cords.
Figure 7:
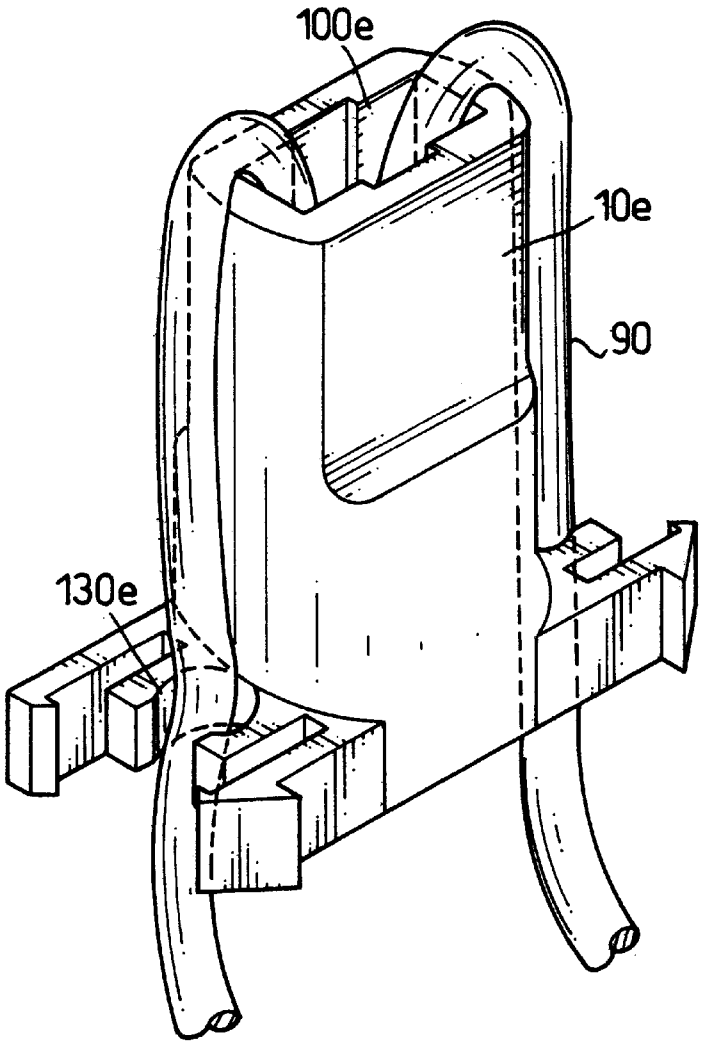

FIG. 7 shows two perspective views in diametrically opposite directions, showing the fifth embodiment of the bulb-holder provided with a pair of cords (90).

As can be seen, the two cords (90) extend out of the tubular body (10*e*), through the cord hole (100*e*), and are retained in the C-shaped notches (130*e*) of the wings, respective, thereby being secured alongside the tubular body (10*e*) of inventive bulb-holder.

Figure 8:
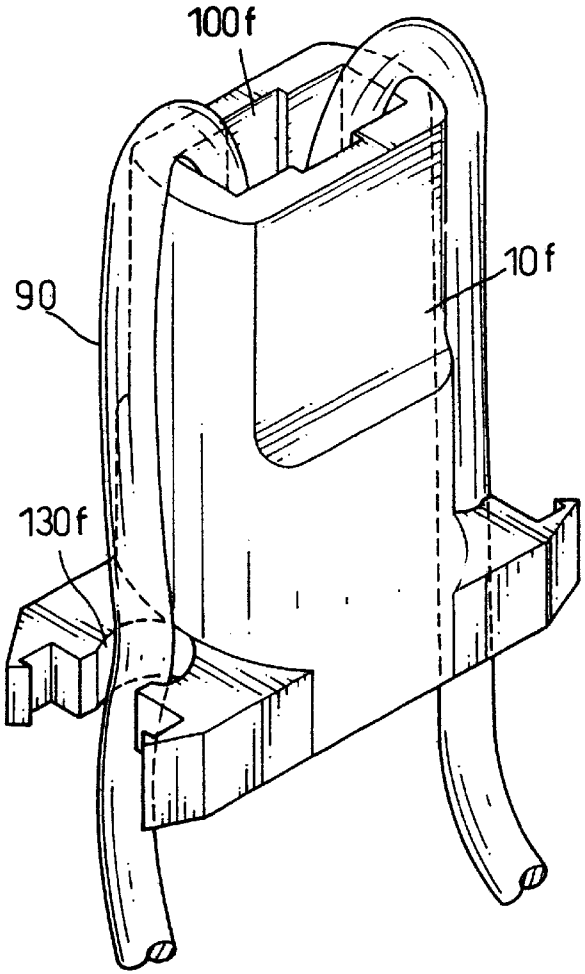
FIG. 8 has two perspective views in diametrically opposite directions, showing the sixth embodiment of the bulb-holder provided with a pair of cords.
Figure 8:
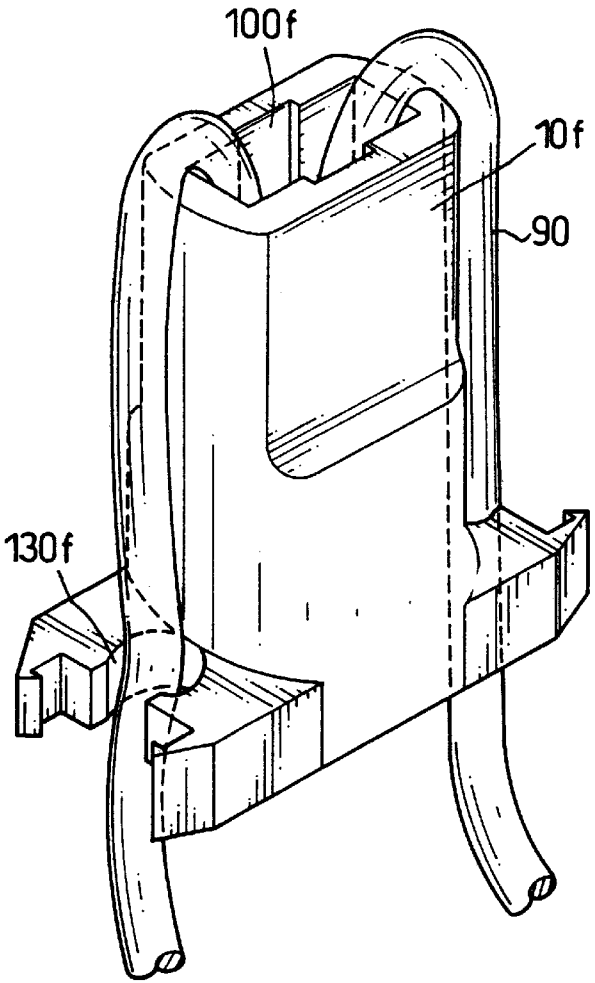

FIG. 8 shows two perspective views in diametrically opposite directions, showing the sixth embodiment of the bulb-holder provided with a pair of cords (90).

These two cords (90) extend out of the tubular body (10*f*), through the cord hole (100*f*), and are retained in the C-shaped notches (130*f*) of the wings, respectively, thereby being secured alongside the tubular body (10*f*) of the bulb-holder.

Figure 9:
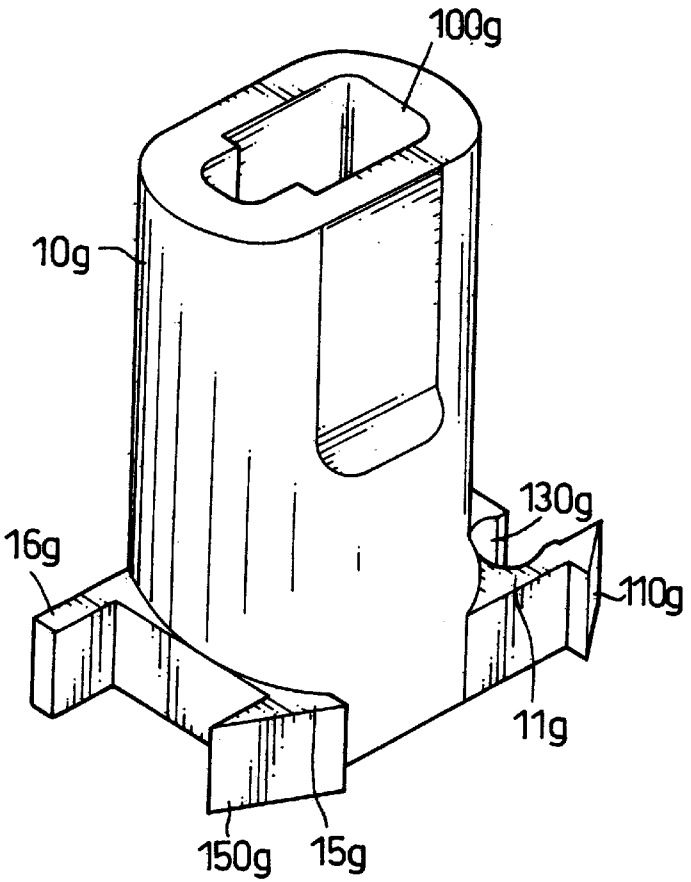
FIG. 9 has two perspective views, viewed in diametrically opposite directions, of a seventh embodiment of the inventive bulb-holder.
Figure 9:
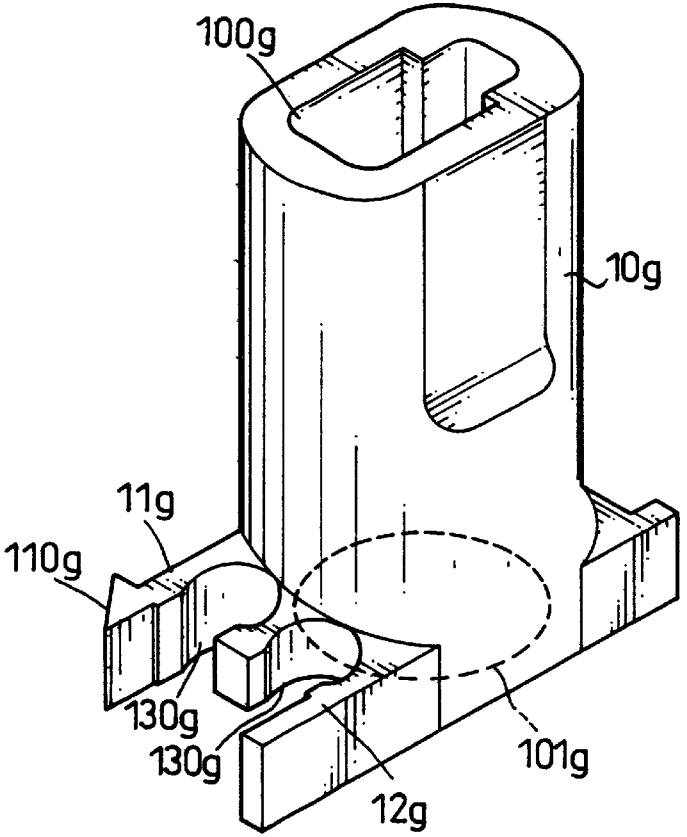

FIG. 9 shows two perspective views, viewed in diametrically opposite directions, of a seventh embodiment of the inventive bulb-holder. In this embodiment, the bulb-holder includes a tubular body (10*g*) having a first end defining a cord hole (100*g*) and a second end defining a bulb-receiving opening (101*g*), with opposed first and second wings (not numbered) extending outward from the tubular body (10*g*) near the second end.

This seventh embodiment is similar to the first embodiment shown in FIG. 1, except for its first wing. The first wing here is also formed with a first mouth opening (not numbered) delimited laterally by a first long jaw (11*g*) and a second long jaw (12*g*), with the first long jaw (11*g*) having an outer inclined face (110*g*) formed at a distal end thereof. The first mouth opening is delimited inwardly by a mouth base which, however, defines two C-shaped notches (130*g*) therein now.

The second wing here is formed with a second mouth opening (not numbered) delimited laterally by a first short jaw (15*g*) and a second short jaw (16*g*). The first short jaw (15*g*), substantially opposed to the first long jaw (11*g*), has an outer inclined face (150*g*) formed at a distal end thereof in correspondence with the outer inclined face (110*g*) of the first long jaw (11*g*).

Figure 10:
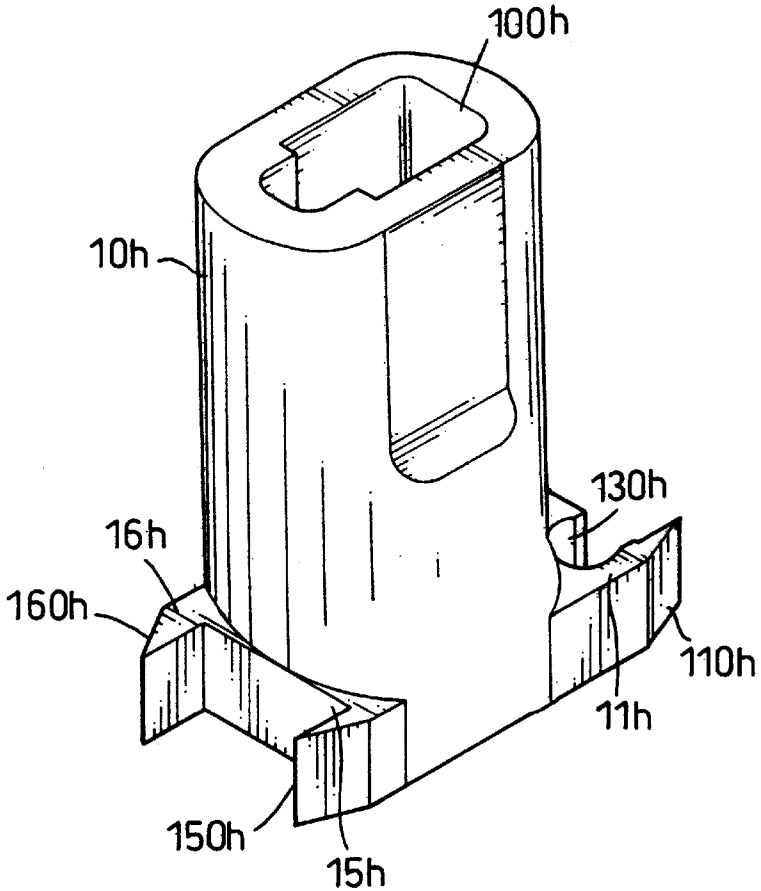
FIG. 10 has two perspective views, viewed in diametrically opposite directions, of an eighth embodiment of the inventive bulb-holder.
Figure 10:
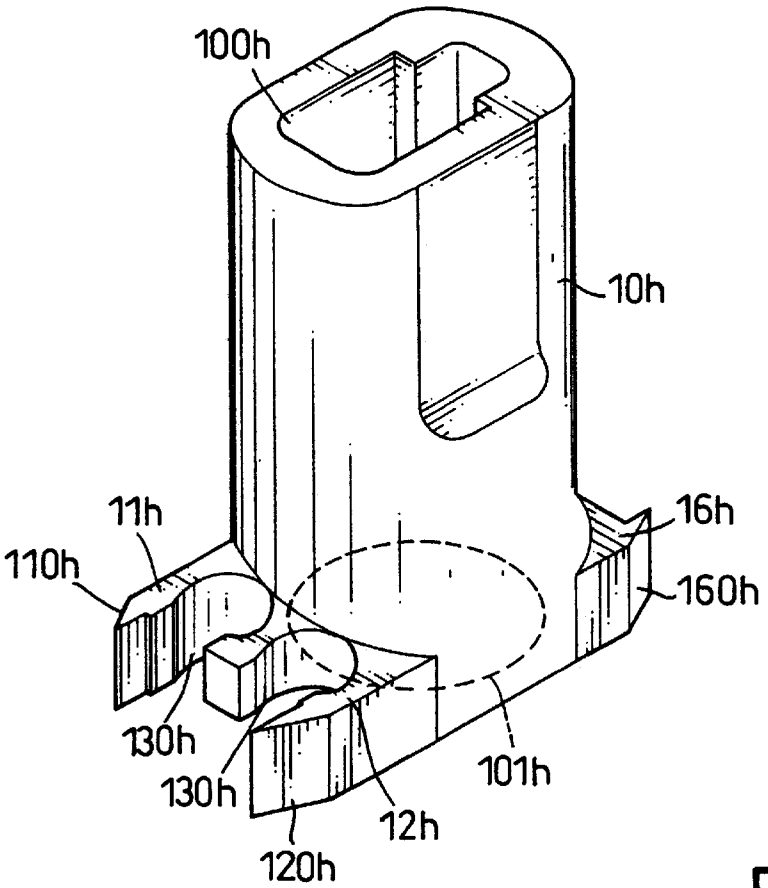

FIG. 10 shows two perspective views, viewed in diametrically opposite directions, of an eighth embodiment of the inventive bulb-holder. In this embodiment, the bulb-holder includes a tubular body (10*h*) having a first end defining a cord hole (100*h*) and a second end defining a bulb-receiving opening (101*h*), with opposed first and second wings (not numbered) extending outward from the tubular body (10*h*) near the second end.

This eighth embodiment is similar to the second embodiment shown in FIG. 2, except for its first wing. The first wing here is also formed with a first mouth opening (not numbered) delimited laterally by a first long jaw (11*h*) and a second long jaw (12*h*), with each long jaw (11*h*, 12*h*) having an outer inclined face (110*h*, 120*h*) formed at a distal end thereof. The first mouth opening is delimited inwardly by a mouth base which, however, defines two C-shaped notches (130*h*) therein.

The second wing here is formed with a second mouth opening (not numbered) delimited laterally by a first short jaw (15*h*) and a second short jaw (16*h*). The short jaws (15*h*,16*h*) are substantially opposed to the long jaws (11*h*, 12*h*), and have respective outer inclined faces (150*h*, 160*h*) formed at distal ends thereof in correspondence with those (110*h*, 120*h*) of the long jaws (11*h*, 12*h*) of the first wing.

Figure 11:
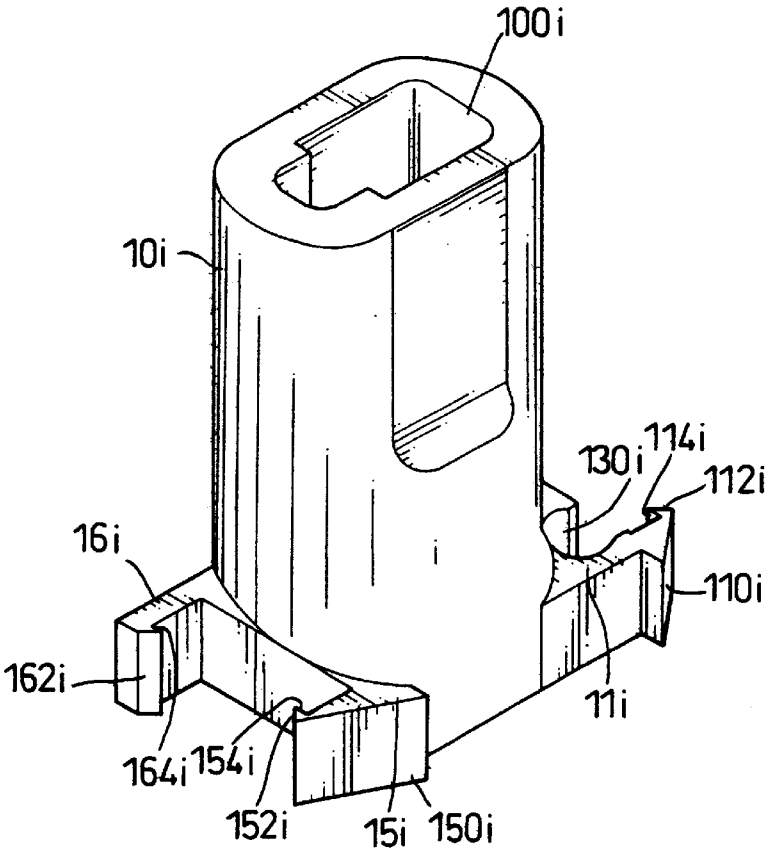
FIG. 11 has two perspective views, viewed in diametrically opposite directions, of a ninth embodiment of the inventive bulb-holder.
Figure 11:
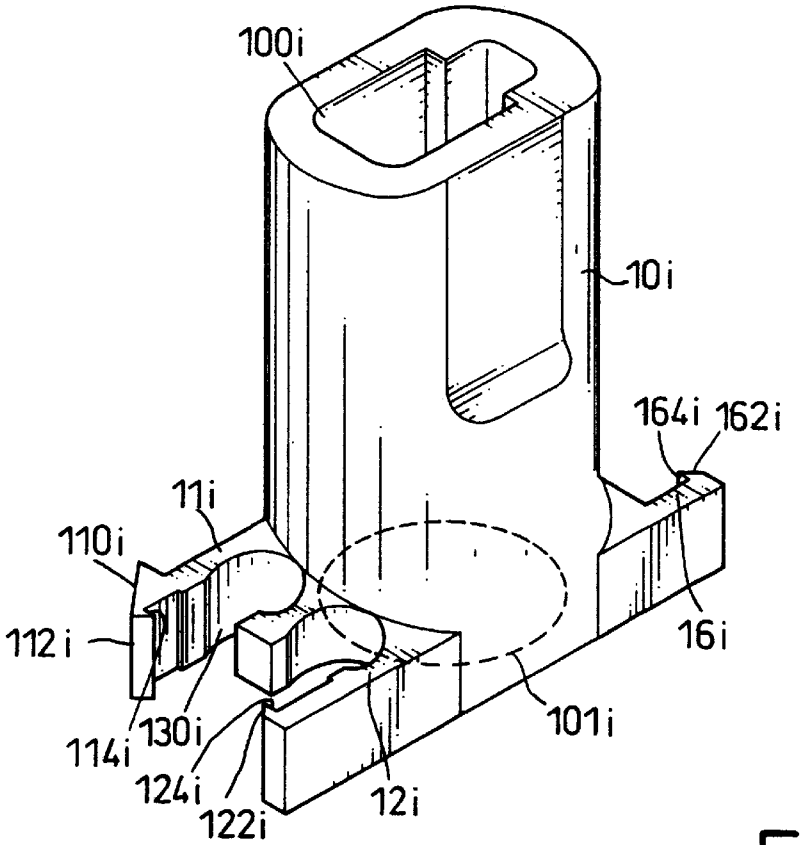

FIG. 11 shows two perspective views, viewed in diametrically opposite directions, of a ninth embodiment of the inventive bulb-holder. In this embodiment, the bulb-holder includes a tubular body (10*i*) having a first end defining a cord hole (100*i*) and a second end defining a bulb-receiving opening (101*i*), with opposed first and second wings (not numbered) extending outward from the tubular body (10*i*) near the second end.

This ninth embodiment is similar to the third embodiment shown in FIG. 3, except for its first wing. The first wing here is also formed with a first mouth opening (not numbered) delimited laterally by a first long jaw (11*i*) and a second long jaw (12*i*), with the first long jaw (11*i*) having an outer inclined face (110*i*) formed at a distal end thereof, and with each of the long jaws (11*i*, 12*i*) having an inner barb (114*i*, 124*i*) which forms an inner inclined face (112*i*, 122*i*) at a distal end of the jaw (11*i*, 12*i*). The first mouth opening is delimited inwardly by a mouth base which, however, defines two C-shaped notches (130*i*) therein now.

The second wing here is formed with a second mouth opening (not numbered) delimited laterally by a first short jaw (15*i*) and a second short jaw (16*i*). The first short jaw (15*i*), substantially opposed to the first long jaw (11*i*), has an outer inclined face (150*i*) formed at a distal end thereof in correspondence with the outer inclined face (110*i*) of the first long jaw (11*i*). In addition, each of the short jaws (15*i*, 16*i*) also has an inner barb (154*i*, 164*i*) which forms an inner inclined face (152*i*, 162*i*) at a distal end of the jaw (15*i*, 16*i*).

Figure 12:
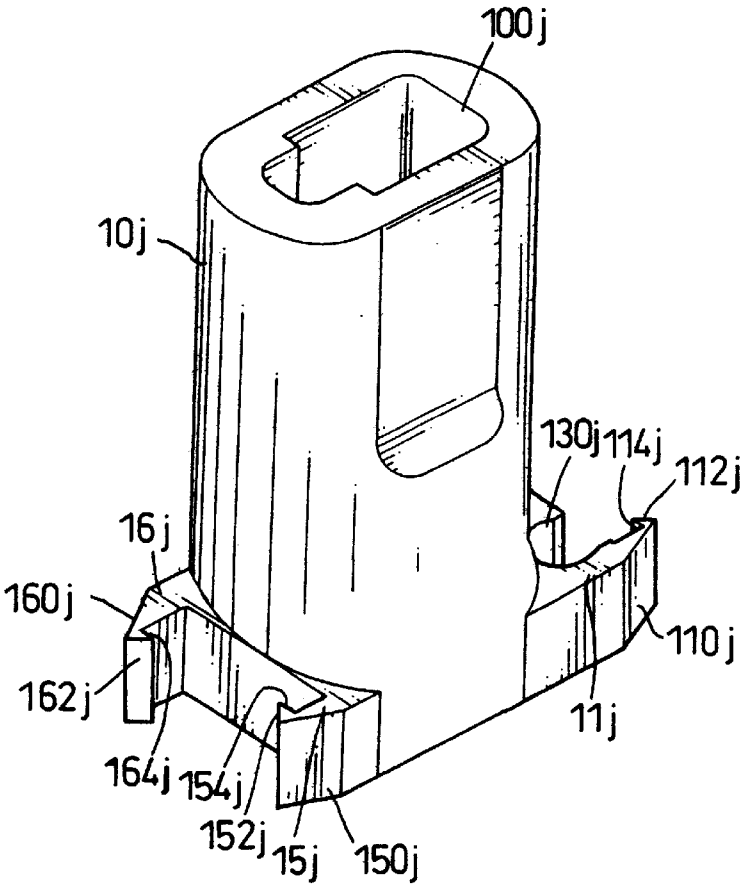
FIG. 12 has two perspective views, viewed in diametrically opposite directions, of a tenth embodiment of the inventive bulb-holder.
Figure 12:
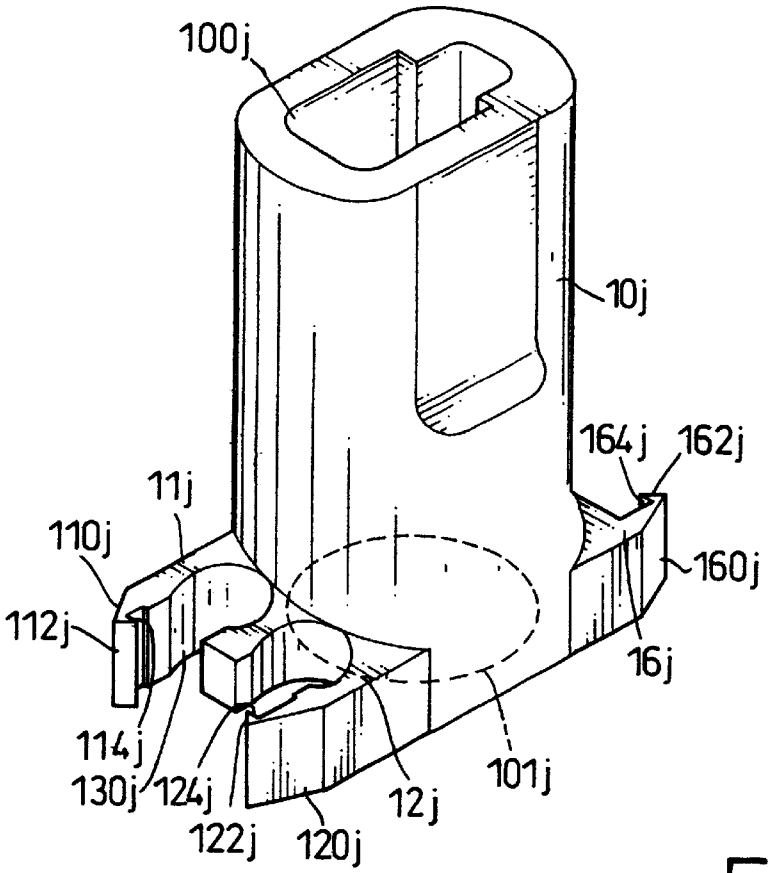

FIG. 12 shows two perspective views, viewed in diametrically opposite directions, of a tenth embodiment of the inventive bulb-holder. In this embodiment, the bulb-holder includes a tubular body (10*j*) having a first end defining a cord hole (100*j*) and a second end defining a bulb-receiving opening (101*j*), with opposed first and second wings (not numbered) extending outward from the tubular body (10*j*) near the second end.

This tenth embodiment is similar to the fourth embodiment shown in FIG. 4, except for its first wing. The first wing here is also formed with a first mouth opening (not numbered) delimited laterally by a first long jaw (11*j*) and a second long jaw (12*j*), with each of the long jaws (11*j*, 12*j*) having an outer inclined face (110*j*, 120*j*) formed at a distal end thereof and having an inner barb (114*j*, 124*j*) which forms an inner inclined face (112*j*, 122*j*) at a distal end of the jaw (11*j*, 12*j*). The first mouth opening is delimited inwardly by a mouth base which, however, defines two C-shaped notches (130*j*) therein.

The second wing here is formed with a second mouth opening (not numbered) delimited laterally by a first short jaw (15*j*) and a second short jaw (16*j*). The first short jaw (15*j*), substantially opposed to the first long jaw (11*j*), has an outer inclined face (150*j*) formed at a distal end thereof in correspondence with the outer inclined face (110*j*) of the first long jaw (11*j*). In addition, each of the short jaws (15*j*, 16*j*) also has an inner barb (154*j*, 164*j*) which forms an inner inclined face (152*j*, 162*j*) at a distal end of the jaw (15*j*, 16*j*).

Figure 13:
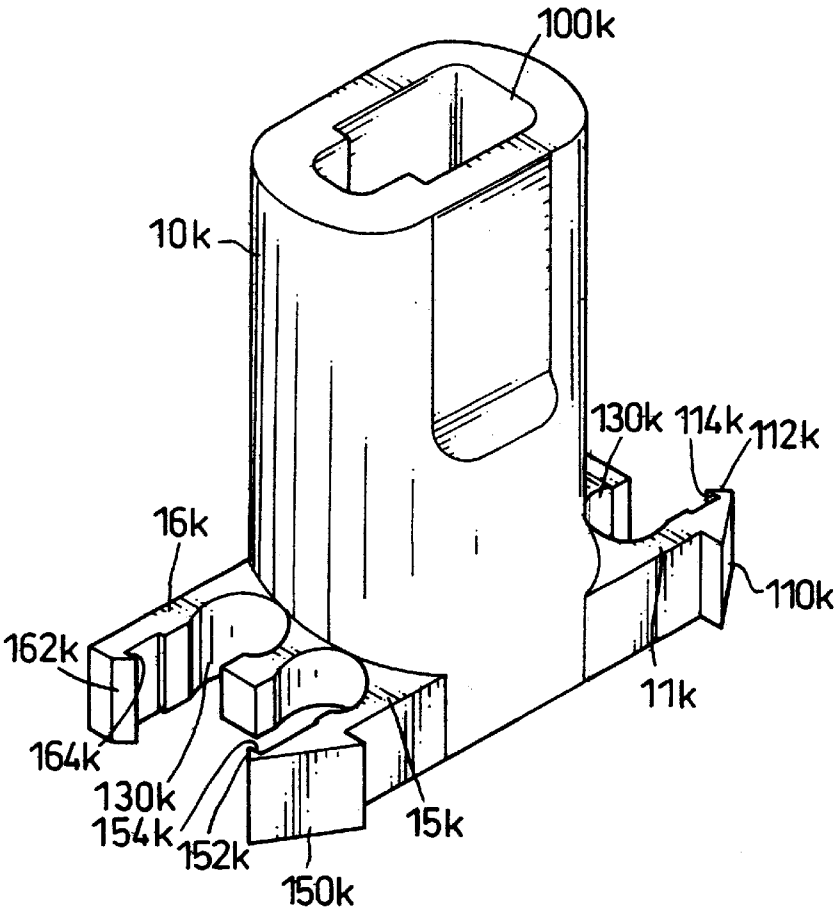
FIG. 13 has two perspective views, viewed in diametrically opposite directions, of an eleventh embodiment of the inventive bulb-holder.
Figure 13:
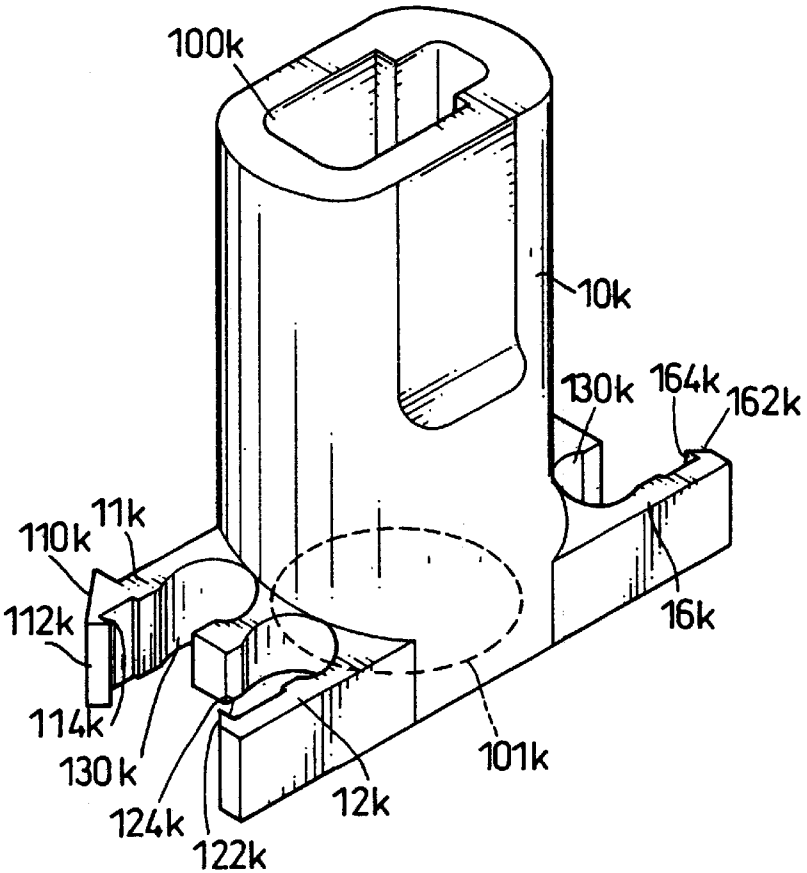

FIG. 13 shows two perspective views, viewed in diametrically opposite directions, of an eleventh embodiment of the inventive bulb-holder. In this embodiment, the bulb-holder includes a tubular body (10*k*) having a first end defining a cordhole (100*k*) and a second end defining a bulb-receiving opening (101*k*), with opposed first and second wings (not numbered) extending outward from the tubular body (10*k*) near the second end.

The two wings here are symmetrically about the tubular body (10*k*), and are each configured in the same configuration as the first wing in the ninth embodiment shown in FIG. 11.

This means that each of the wings is formed with a mouth opening (not numbered) delimited laterally by a first long jaw (11*k*, 15*k*) and a second long jaw (12*k*, 16*k*) with the first jaw (11*k*, 15*k*) having an outer inclined face (110*k*, 150*k*) formed at a distal end thereof, but with each jaw (11*k*, 12*k*, 15*k*, 16*k*) having an inner barb (114*k*, 124*k*, 154*k*, 164*k*), which forms an inner inclined face (112*k*, 122*k*, 15*k*, 16*k*) at a distal end of the jaw (11*k*, 12*k*, 15*k*, 16*k*).

Furthermore, each mouth opening is delimited inwardly by a mouth base which defines two C-shaped notches (130*k*) therein.

Figure 14:
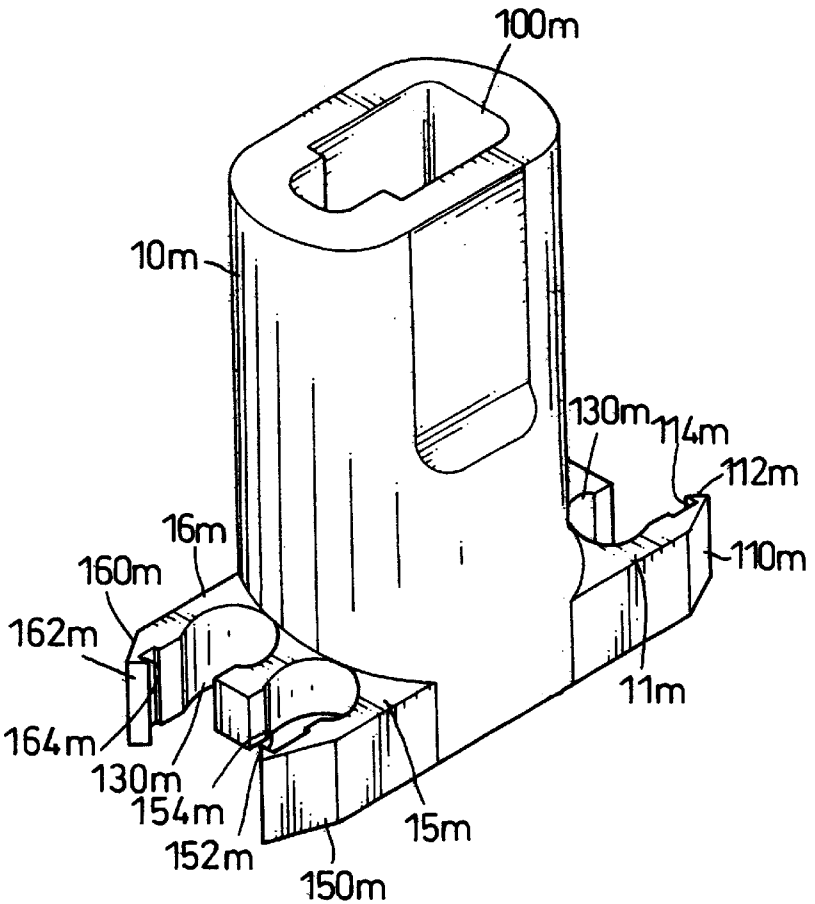
FIG. 14 has two perspective views, viewed in diametrically opposite directions, of a twelfth embodiment of the inventive bulb-holder.
Figure 14:
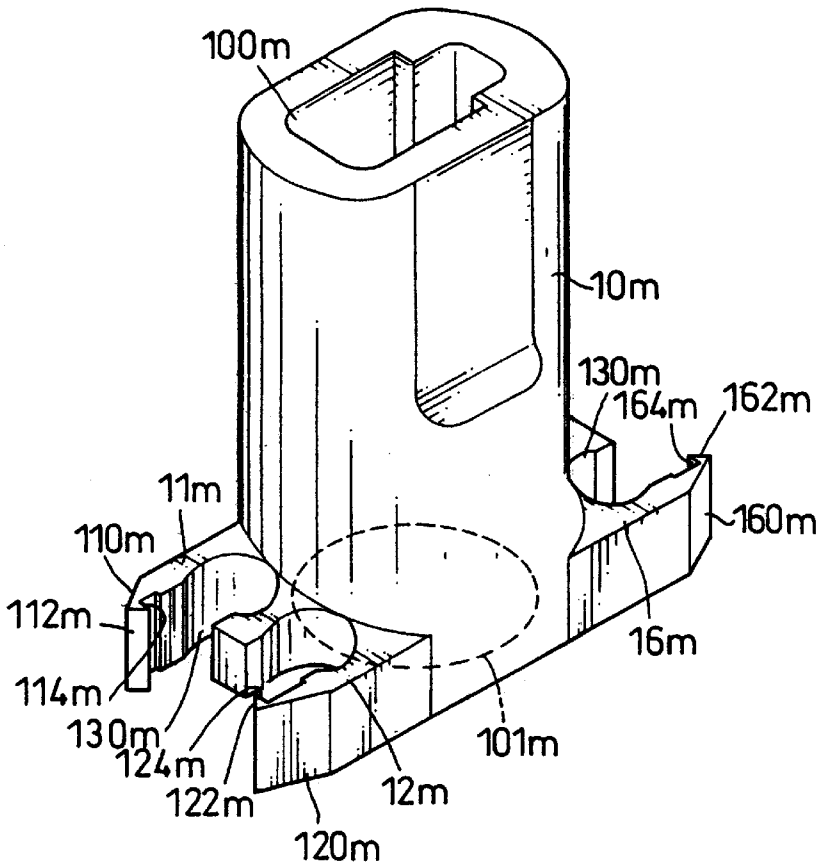

FIG. 14 shows two perspective views, viewed in diametrically opposite directions, of a twelfth embodiment of the inventive bulb-holder. In this embodiment, the bulb-holder includes a tubular body (10*m*) having a first end defining a cord hole (100*m*) and a second end defining a bulb-receiving opening (101*m*), with opposed first and second wings (not numbered) extending outward from the tubular body (10*m*) near the second end.

These two wings are also symmetrically about the tubular body (10*m*), but are each configured in the same configuration as the first wing in the tenth embodiment shown in FIG. 12.

In detail, each of the wings here is formed with a mouth opening (not numbered) delimited laterally by a pair of long jaws (11*m,* 12*m;* 15*m,* 16*m*), each having an outer inclined face (110*m,* 120*m;* 150*m,* 160*m*) formed at a distal end thereof and each having an inner barb (114*m,* 124*m;* 154*m,* 164*m*), which forms an inner inclined face (112*m,* 122*m;* 152*m,* 162*m*) at the distal end of the jaw (11*m,* 12*m,* 15*m,* 16*m*).

Moreover, each mouth opening is delimited inwardly by a mouth base which defines two C-shaped notches (130*m*) therein.

Figure 15:
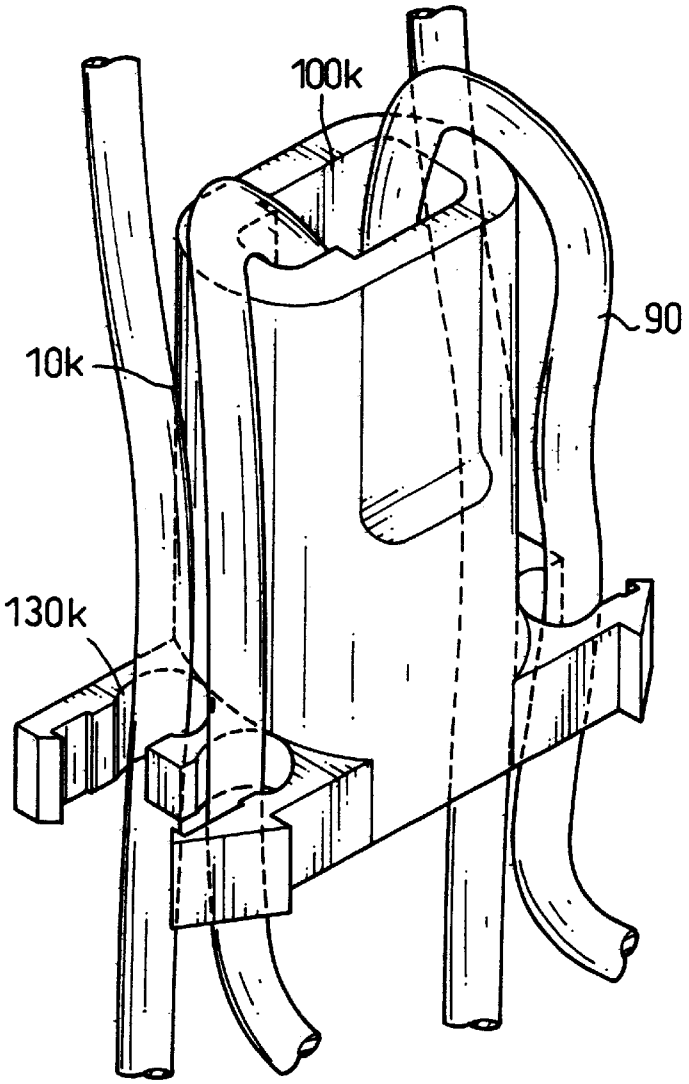
FIG. 15 has two perspective views, viewed in diametrically opposite directions, showing the eleventh embodiment of the bulb-holder provided with two pairs of cords.
Figure 15:
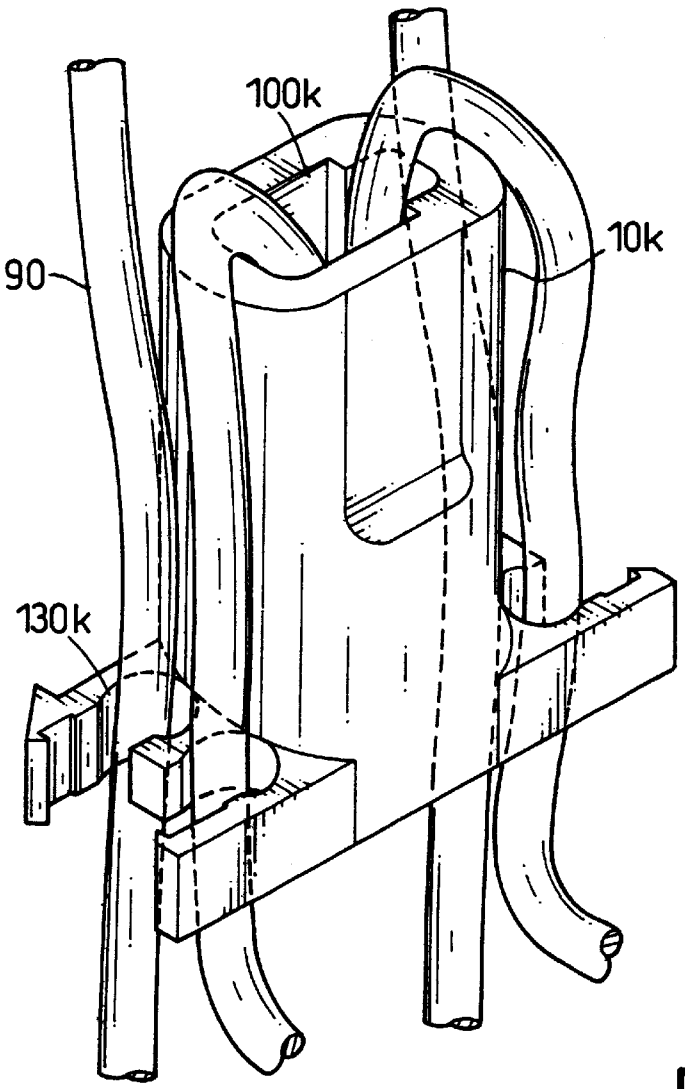

FIG. 15 shows two perspective views in diametrically opposite directions, showing the eleventh embodiment of the bulb-holder provided with two pairs of cords (90).

With the bulb-holder, one pair of the cords (90) may extend out of the tubular body (10*k*) through the cord hole (100*k*) and may be retained in the C-shaped notches (130*k*) of the opposed wings, while the other pair of the cords (90) may extend parallelly to the tubular body (10) and may also be retained in the other C-shaped notches (130*k*) of the wings. This securely holds the cords (90) alongside the tubular body (10*k*) of the inventive bulb-holder.

Figure 16:
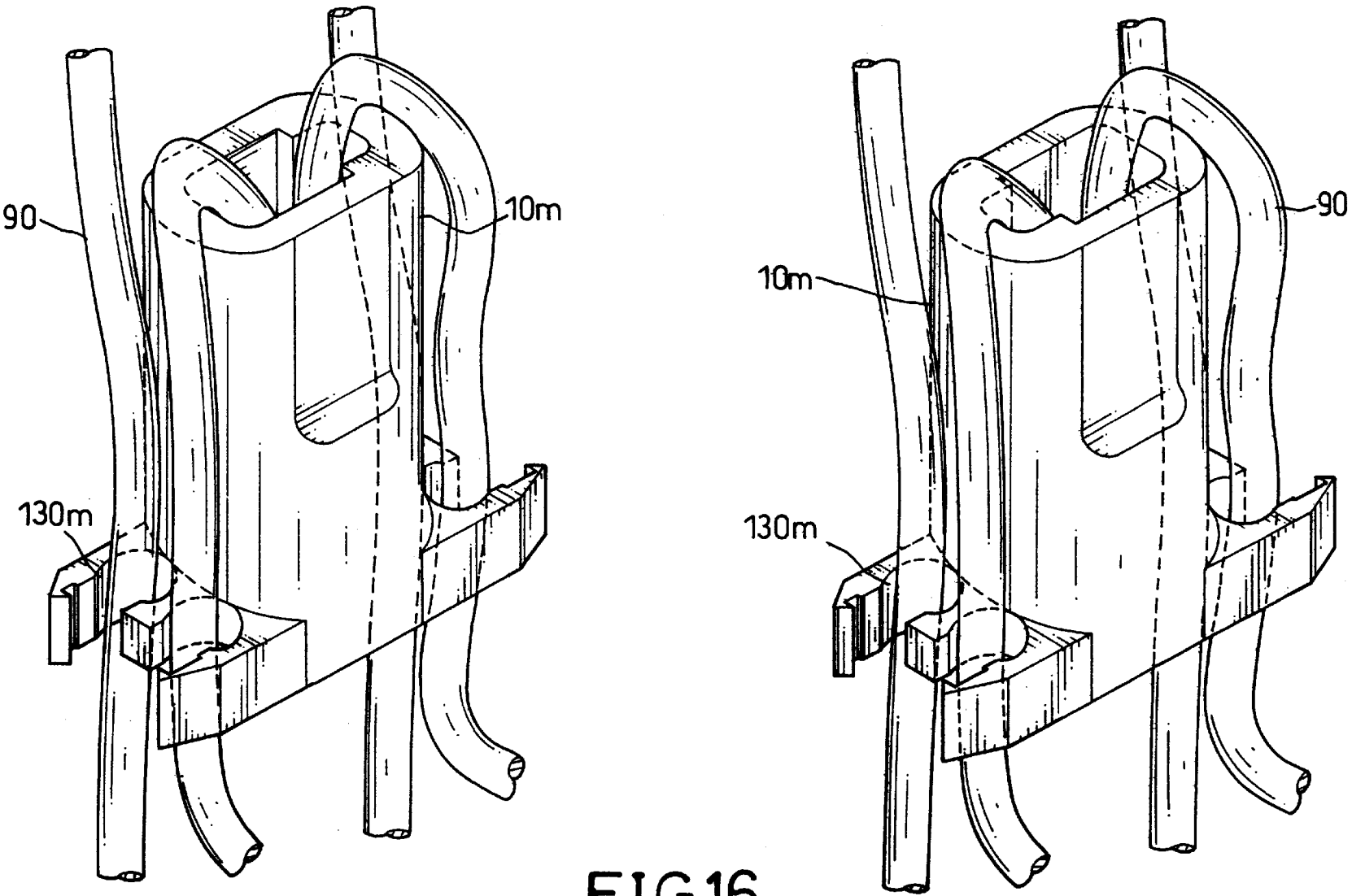
FIG. 16 has two perspective views in diametrically opposite directions, showing the twelfth embodiment of the bulb-holder provided with two pairs of cords.

FIG. 16 shows two perspective views in diametrically opposite directions, showing the twelfth embodiment of the bulb-holder provided with two pairs of cords (90).

With this bulb-holder, one pair of the cords (90) may extend out of the tubular body (10*k*) through the cord hole (100*k*) and may be retained in the C-shaped notches (130*k*) of the opposed wings, while the other pair of the cords (90) may extend parallelly to the tubular body (10) and may also be retained in the other C-shaped notches (130*k*) of the wings. Similarly, this also securely holds the cords (90) alongside the tubular body (10*k*) of the inventive bulb-holder.

Figure 17:
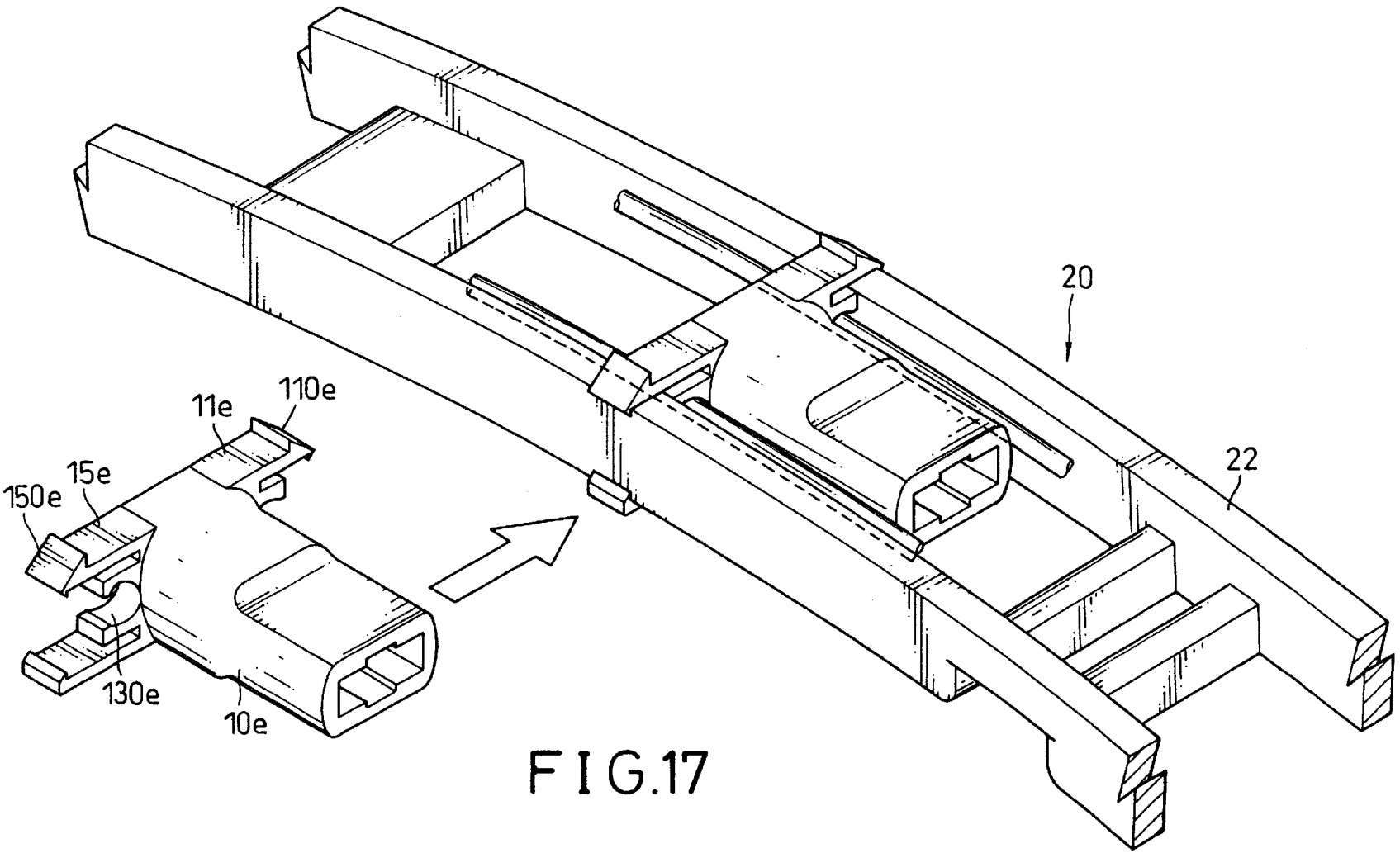
FIG. 17 is a perspective view, illustrating the attachment of the fifth embodiment of the inventive bulb-holder to a track consisting of a pair of spaced rails.

FIG. 17 shows a perspective view, illustrating the attachment of the inventive bulb-holder, e.g. of the fifth embodiment, to a track (20) consisting of a pair of spaced rails (22).

The bulb-holder is attached to the track (20) by retaining the cords (90) in the C-shaped notches (130*k*) of the wings. The bulb-holder is then pressed onto the track (20), with the outer inclined faces (110*e,* 150*e*) of the first jaws (11*e,* 15*e*) against the respective rail (22).

It is due to the inclined faces (110*e,* 150*e*) that the spaced rails (22) are deformed or bent outward until they snap into the mouth openings in the wings of the bulb-holder, when the bulb-holder is held on the track (20).

Figure 18:
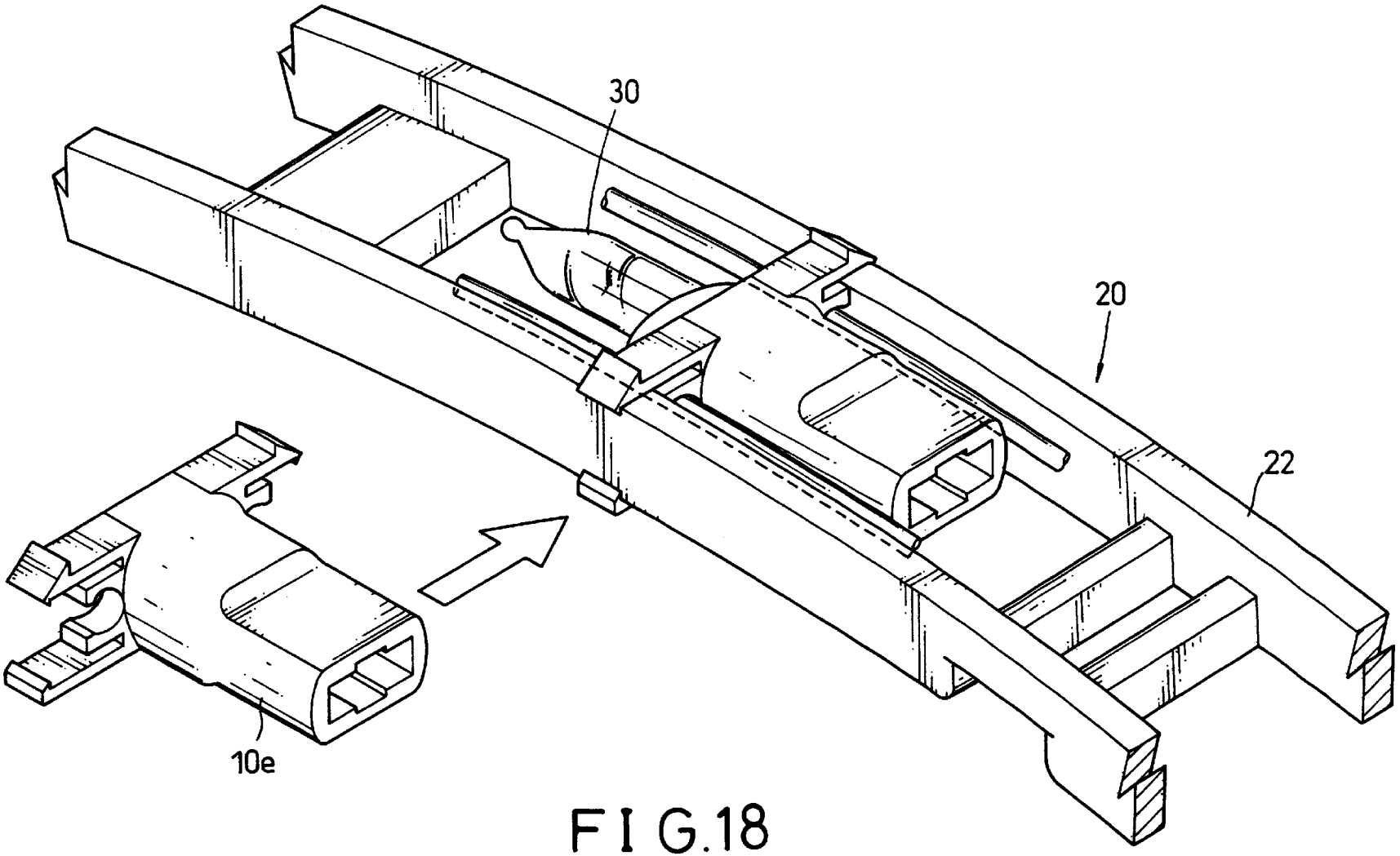
FIG. 18 is a perspective view similar to FIG. 17, but showing a bulb additionally plugged into the bulb-holder.

FIG. 18 shows a perspective view similar to FIG. 17, but showing a bulb (30) additionally plugged into the bulb-holder. Now the bulb (30), together with the tubular body (10*e*), is situated in a space between the rails (22), so that it may give out light afar from both sides of the track (20).

Figure 19:
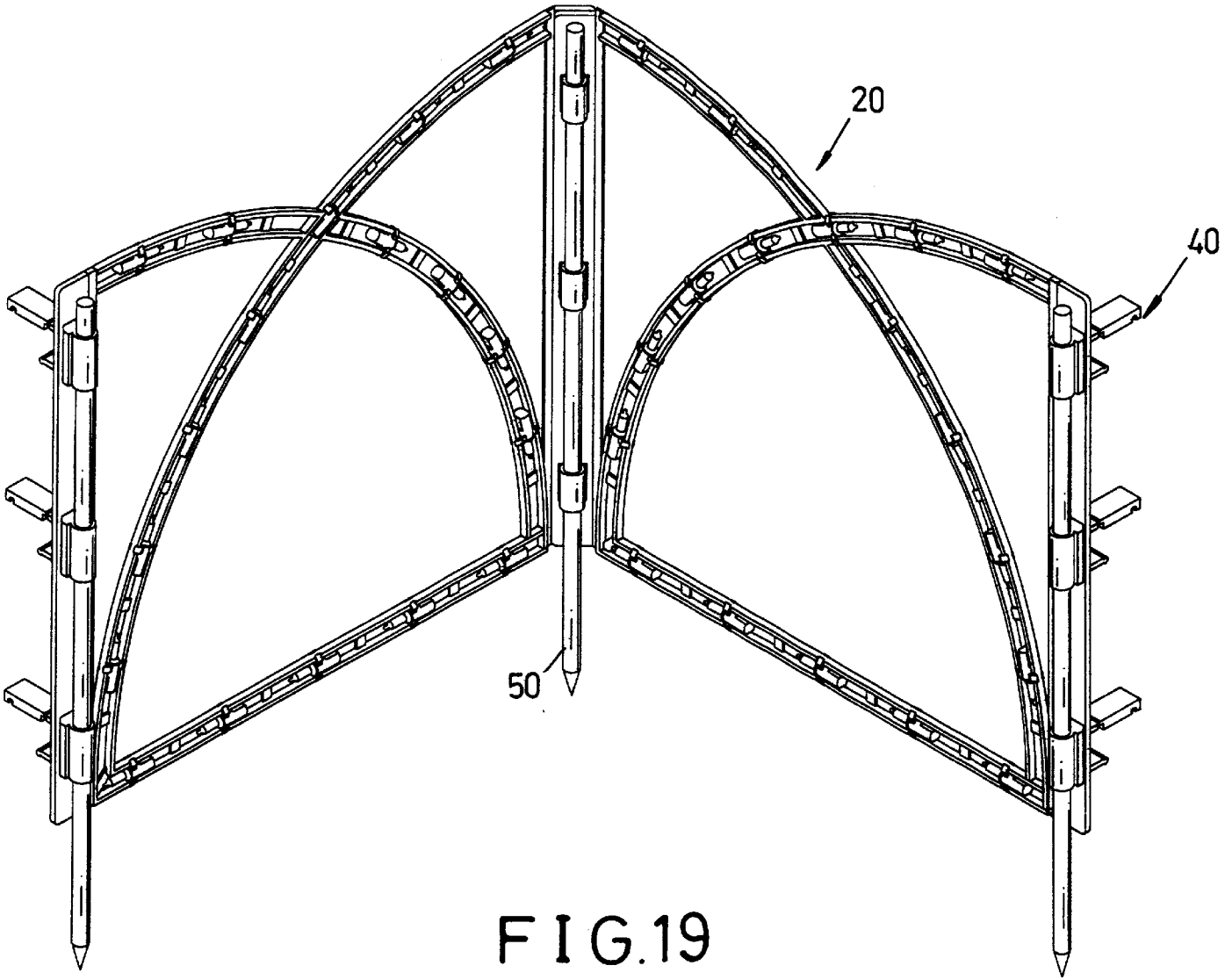
FIG. 19 is a perspective view of a decorative lamp configured as a fence incorporated with the inventive bulb-holders.

FIG. 19 shows a perspective view of a decorative lamp (not numbered) configured as a fence incorporated with the inventive bulb-holders. The fence may include two or more units, each having two quarter-circles of the track(s) (20). Each unit further has a straight sidepiece (24) on its either side, for connecting one unit to another.

Figure 20:
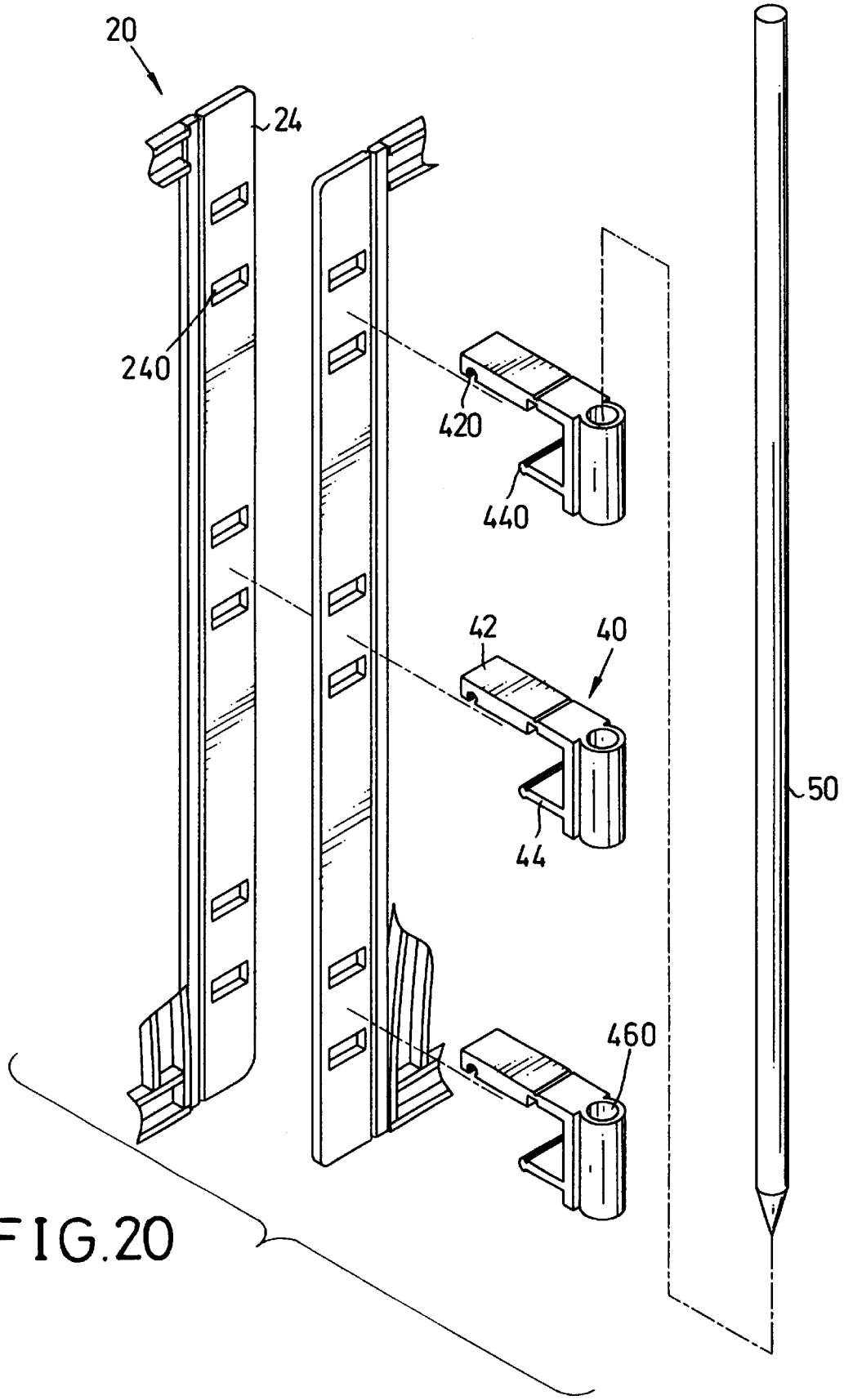
FIG. 20 is an exploded, enlarged perspective view of parts of the fence shown in FIG. 19.

FIG. 20 shows an exploded, enlarged perspective view of parts of the fence. As illustrated, each of the sidepieces (24) of the adjacent units has a plurality of twin-buttonholes (240) in alignment with those (240) defined in the sidepiece of the other unit.

The adjacent sidepieces (24) can be attached to each other, such as by a plurality of fasteners (40) that each have a flexible tab (42) with a C-slot (420) and a rigid tab (44) with an enlarged free edge (440).

The attachment is achieved by passing the tabs (42) through corresponding ones of the buttonholes (24) before bending the flexible tab (42) towards the rigid tab (44). Once the enlarged free edge (440) is snapped into the C-slot (420), the fastener (40) is closed as a whole, thereby joining the sidepieces (24) and hence the adjacent units together.

In a more preferable embodiment, each of the fasteners (44) may be further formed with respective sleeves (460) to allow an upright pole (50) to extend therethrough. The decorative fence will stand up on the ground, as best shown in FIG. 19, as soon as the poles (50) are inserted into the earth in a particular place, such as in a garden.

From the above description, it is noted that the invention has the advantage of allowing the bulb(s) (30) to give out light afar from both sides of the tracks (20) of the fence.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bulb holder for use in a decorative lamp, comprising a tubular body having a first end defining a cord hole and a second end defining a bulb-receiving opening, and said tubular body further having a first wing formed with a first mouth opening and an opposed second wing formed with a second mouth opening, wherein said first mouth opening of said first wing is delimited laterally by a first long jaw and a second long jaw spaced from said first long jaw and wherein said second mouth opening of said second wing is delimited laterally by a first short jaw and a second short jaw spaced from said first short jaw, wherein said mouth opening of any wing including the first and second long jaws is delimited inwardly by a mouth base, and wherein said mouth base defines a notch for retaining a cord therein, wherein said first short jaw of said second wing is opposed to said first long jaw of said first wing, and wherein said second short jaw of said second wing is opposed to said second long jaw of said first wing, and wherein said first long jaw has an outer inclined face formed at a distal end thereof, and wherein said first short jaw has an outer inclined face formed at a distal end thereof in correspondence with said outer inclined face of said first long jaw, wherein said jaws of said wings each have an inner barb formed thereon, and wherein said inner barbs form respective inner inclined faces at distal ends of said jaws wherein said wings extend outward from said tubular body near said second end, wherein said second long jaw has an outer inclined face formed at a distal end thereof, and wherein said second short jaw has an outer inclined face formed at a distal end thereof in correspondence with said outer inclined face of said second long jaw, wherein said jaws of said wings each have an inner barb formed thereon, and wherein said inner barbs form respective inner inclined faces at distal ends of said jaws, wherein each of said wings includes a first long jaw and a second long jaw both laterally delimiting a corresponding one of said mouth openings therebetween, wherein said first long jaws of said wings are opposed to each other, and wherein said second long jaws of said wings are opposed to each other, and wherein each of said first long jaws of said wings has an outer inclined face formed at a distal end thereof, wherein each of said second long jaws of said wings also has an outer inclined face formed at a distal end thereof, wherein said jaws of said wings each have an inner barb formed thereon, and wherein said inner barbs form respective inner inclined faces at distal ends of said of said jaws, wherein said mouth opening of any wing including two long jaws is delimited inwardly by a mouth base, and wherein said mouth base defines a notch for retaining a cord therein.

2. The bulb holder as claimed in claim 1, wherein said mouth base defines two notches each for retaining a cord therein.

* * * * *